US006863558B2

(12) United States Patent
Negishi et al.

(10) Patent No.: US 6,863,558 B2
(45) Date of Patent: Mar. 8, 2005

(54) PAIRED ELECTRICAL CABLE CONNECTOR

(75) Inventors: Satoshi Negishi, Shizuoka (JP); Hirohisa Ueda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/875,989

(22) Filed: Jun. 25, 2004

(65) Prior Publication Data

US 2004/0229495 A1 Nov. 18, 2004

Related U.S. Application Data

(62) Division of application No. 10/345,358, filed on Jan. 16, 2003.

(30) Foreign Application Priority Data

Mar. 20, 2002 (JP) ..... 2002-78159
Mar. 20, 2002 (JP) ..... 2002-78161

(51) Int. Cl.[7] ..... H01R 4/24; H01R 4/26; H01R 11/20

(52) U.S. Cl. ..... 439/404; 439/409

(58) Field of Search ..... 439/404, 409–410, 439/402, 417, 596

(56) References Cited

U.S. PATENT DOCUMENTS 4,997,388 A 3/1991 Dale et al. ..... 439/404
5,190,468 A 3/1993 Nichols, III et al. ..... 439/404
5,199,899 A 4/1993 Ittah ..... 439/403
5,338,220 A 8/1994 Soes et al. ..... 439/403
5,562,478 A 10/1996 Yamamoto ..... 439/402
5,664,963 A 9/1997 Yamamoto et al. ..... 439/409
5,820,404 A 10/1998 Chishima et al. ..... 439/417

*Primary Examiner*—Hae Moon Hyeon
(74) *Attorney, Agent, or Firm*—Armstrong, Kratz, Quintos, Hanson & Brooks, LLP

(57) ABSTRACT

The electrical connector has a pair of first and second terminal fittings each connected to each of a pair of first and second electrical cables and a connector housing holding the terminal fittings. The electrical connector comprises a cable distinction device for electrically connecting the first electrical cable to the first electrical cable and the second electrical cable to the second electrical cable. The cable distinction device has a cutout with a shoulder, the cutout allowing insertion of the electrical cables into the connector housing, the shoulder positioned at a middle of an inner edge of the cutout, and the shoulder allows insertion of the first electrical cable but prevents insertion of the second electrical cable into the connector housing. The first and second electrical cables have an outer diameter equal to each other, and the first electrical cable has a protrusion projecting from an outer surface of a sheath to abut against the shoulder of the cutout when inserted in to the cutout. Alternatively, the first electrical cable may have an outer diameter larger than that of the second electrical, and the first electrical cable abuts against the shoulder of the cutout when inserted in to the cutout.

1 Claim, 22 Drawing Sheets

3a, 3b } 3

21a, 21b, 33a, 33b } 72

PAIRED ELECTRICAL CABLE CONNECTOR

This application is a divisional application of Ser. No. 10/345,358 filed Jan. 16, 2003.

BACKGROUND OF THE INVENTION

1. Field of the Invention

The present invention relates to a paired electrical cable and a connector for the pair electrical cable.

2. Related Art

A recent motor vehicle has various kinds of electronic instruments so that the vehicle is arranged with wiring harnesses for transmitting various signals and power to the electronic instruments of the vehicle. The wiring harness has a plurality of electrical cables and connectors joined to ends of the electrical cables for supplying various signals and power to the electronic instruments.

For supplying various signals and power to the electronic instruments, there is provided a paired electrical cable consisting of two cables. One of the electrical cables transmits a signal and the other electrical cable transmits another signal which is opposite in phase. The paired cable decreases noise generated in the cables.

Some motor vehicles have an optional electrical instrument according to a request of a user. This requires supplying additional power and signals to the optional instrument. Thus, new cables are prepared for electrical connection with wiring harnesses having been arranged in the vehicles for transmitting power and signals for the optional instrument. For this purpose, conventional connectors have been utilized.

The electrical cables tend to be received in a narrow space within the vehicle. That is, it is required that a paired cable used for electrical connection of the optical instrument is connected to one of the wiring harnesses within a very narrow space of the vehicle. Such paired cable needs to be connected to another paired cable of the wiring harness such that the signals transmitted through two cables constituting the paired cable are opposite in phase to each other. Thus, the connection of the paired cable to the wiring harness within the narrow space has been a troublesome work.

For correct connection of two of the paired cables, each electrical cable need to be distinguished from each other. Conventionally, a mark or a color is provided on the cables for the distinction thereof.

Furthermore, a recent motor vehicle tends to have an increased number of electronic instruments according to users requests, which increases the number of electrical cables constituting a wiring harness and increases the weight of the wiring harness. Therefore, it has been desired that electrical cables have smaller diameters or sizes to transmit various signals for enabling a wiring harness smaller in size or lighter in weight. However, a smaller diameter paired electrical cable is disadvantageous for recognizing a distinction mark or color for electrical connection thereof in a desired pattern.

SUMMARY OF THE INVENTION

In view of the aforementioned disadvantage, an object of the invention is to provide a paired cable and an electrical connector for connection of such paired electrical cable with ease. Another object of the invention is to provide a paired electrical cable, in which each of the cables constituting the paired electrical cable can be distinguished from the other with ease.

For achieving the object, an aspect of the present invention is an electrical connector having a pair of first and second terminal fittings each connected to each of a pair of first and second electrical cables and a connector housing holding the terminal fittings, wherein the electrical connector comprises a cable distinction device disposed in the connector housing to guide the first and second electrical cables for electrically connecting the first electrical cable exclusively to the first terminal fitting and the second electrical cable exclusively to the second terminal fitting.

Thus, the cable distinction device guides the pair of cables for surely connecting the first electrical cable to the first terminal fitting and the second electrical cable to the second terminal fitting. This prevents incorrect connection between the cables and the terminal fittings and allows an electrical connection work in a blind space.

Preferably, the cable distinction device has a cutout with a shoulder, the cutout allowing insertion of the electrical cables into the connector housing, the shoulder positioned at a middle of an inner length of the cutout, and the shoulder prevents the first electrical cable from advancing over the shoulder but allows the second electrical cable to advance over the shoulder.

Thus, the insertion of the pair of first and second electrical cables into the cutout of the connector housing allows correct connection to the first or second terminal fittings.

Preferably, the first and second electrical cables have an outer diameter equal to each other, and the first electrical cable has a protrusion projecting from an outer surface of a sheath of the first electrical cable to abut against the shoulder of the cutout when inserted into the cutout.

The protrusion of the first cable abuts against the shoulder of the cutout when inserted into the cutout, allowing the correct insertion of the first and second cables in the positioning of the cables in the connector housing.

Alternatively, the first electrical cable has an outer diameter larger than that of the second electrical cable, and the first electrical cable abuts against the shoulder of the cutout when inserted in to the cutout.

The first electrical cable having the larger diameter abuts against the shoulder of the cutout, allowing the correct insertion of the first and second cables in the positioning of the cables in the connector housing.

Preferably, the electrical connector further comprises a cable receiving space and a second cable distinction device, the cable receiving space receiving a pair of third and fourth electrical cables for electrically connecting respectively to one of the first and second electrical cables, and the second cable distinction device allows the third electrical cable to electrically connect to the first electrical cable but prevents the third electrical cable from electrically connecting to the second electrical cable.

Thus, the third and fourth electrical cables are correctly connected to the first and second electrical cable. This is, the third electrical cable is surely electrically connected to the first electrical cable, while the fourth electrical cable is surely connected to the second electrical cable.

Preferably, the second cable distinction device has a pair of cable receiving chambers with a pair of projections oriented inward in the cable receiving chambers, and the cable receiving chambers receive the third and fourth electrical cables, one of the projections allowing insertion of the third electrical cable and preventing insertion of the fourth electrical cable into one of the cable receiving chambers, the other of the projections allowing insertion of the fourth electrical cable and preventing insertion of the third electrical cable into the other of the cable receiving chambers.

The one of the cable receiving chambers receives the third electrical cable while the other of the cable receiving chambers receives the fourth electrical cable. Thus, the third electrical cable is surely electrically connected to the first electrical cable, while the fourth electrical cable is surely electrically connected to the second electrical cable.

Preferably, the third and fourth electrical cables have an outer diameter equal to each other, and the third electrical cable has a second protrusion projecting from an outer surface of a sheath thereof to abut against one of the projections when third electrical cable is inserted into one of the cable receiving chambers.

The third electrical cable has the second protrusion projecting to abut against one of the projections. Thus, the third electrical cable is surely electrically connected to the first electrical cable, while the fourth electrical cable is surely electrically connected to the second electrical cable.

Preferably, the third electrical cable has an outer diameter larger than that of the fourth electrical cable, and the third electrical cable abuts against one of the projections.

The third and fourth electrical cables are selectively received in the cable receiving chamber since the third electrical cable abuts against one of the projections.

The pair of first and second electrical cables are parallel to each other, and the first electrical cable is different from the second electrical cable in a sectional profile for easy distinction of each of the cables from the other.

The first electrical cable may have a main part with a round section and a protrusion formed on an outer surface of the main part, and the second electrical cable has a round section.

The first electrical cable may have a main part with a round section and a projection formed on an outer surface of the main part, and the second electrical cable may have a main part with a round section and a groove formed on an outer surface of the main part of the second electrical cable.

The protrusion may be extended all over a length of the first electrical cable in a longitudinal direction of the first electrical cable.

Alternatively, the protrusion may be annularly extended on the outer surface of the first electrical cable in a lateral direction of the first electrical cable.

The first electrical cable may have a round section, and the second electrical cable may have a polygon section.

DETAILED DESCRIPTION OF THE PREFERRED EMBODIMENTS

Figure 1:
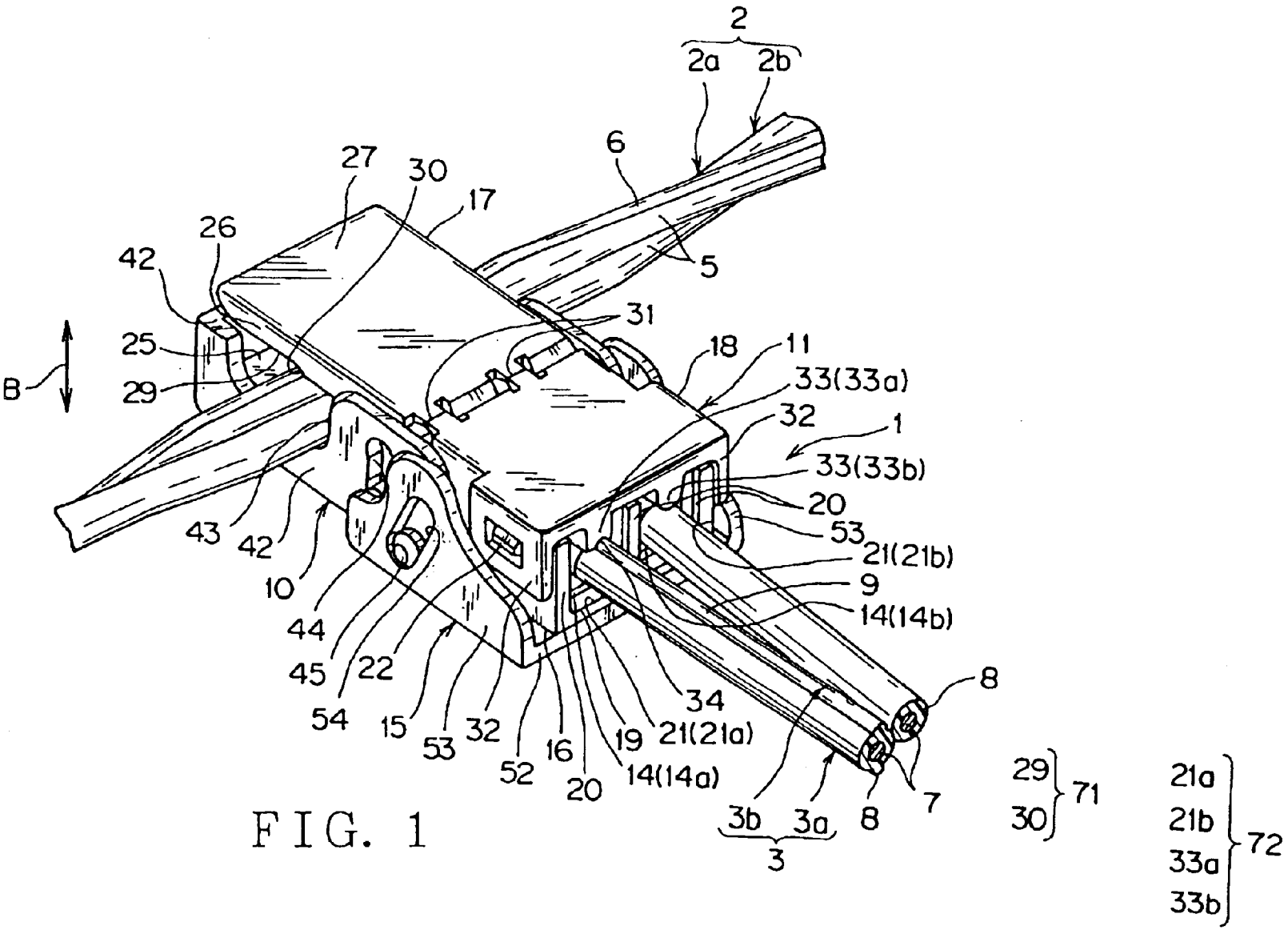
FIG. 1 is a perspective view showing an electrical connector according to a first embodiment of the invention.

Referring to FIGS. 1 to 19, an electrical connector of a first embodiment according to the present invention will be discussed hereinafter. An electrical connector 1 shown FIG. 1 is used for electrically connecting a paired electrical cable 2, which is included in a wiring harness arranged in a motor vehicle, to an additional paired electrical cable 3 of an optional electronic instrument.

Figure 15:
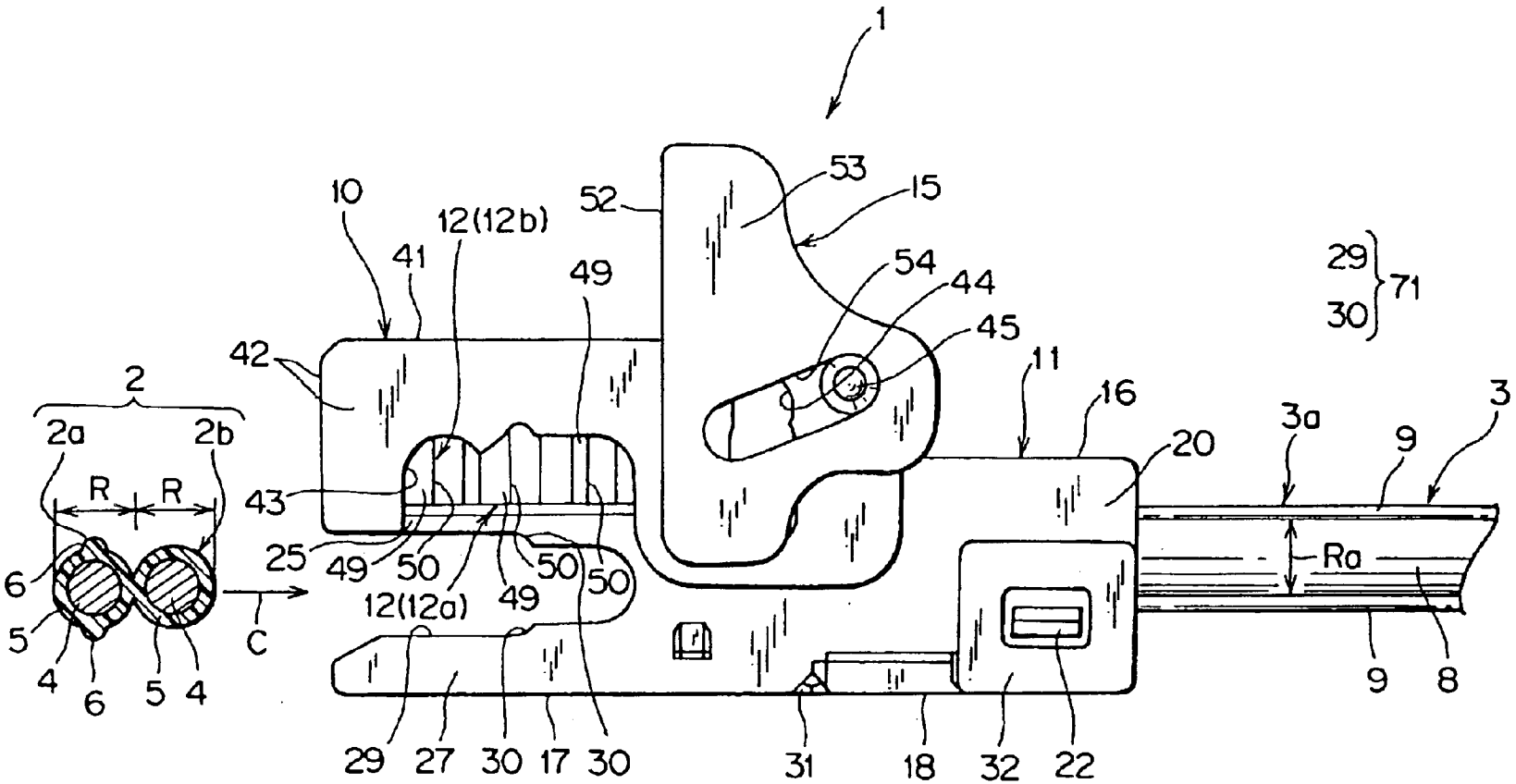
FIG. 15 is a side view showing a connector of FIG. 14.

As best illustrated in FIG. 15, the paired electrical cable 2 has a pair of electrical cables 2*a* and 2*b* parallel to each other. Each of the cables 2*a* and 2*b* is a sheathed electrical cable having a wire core 4 and an insulating sheath 5 covering the wire core 4. The wire core 4 consists of electrically conductive metal wires, and the sheath 5 is made of a synthetic resin. One cable 2*a* has a diameter R (see FIG. 15) equal to that of the other cable 2*b*.

The one cable 2*a* is formed with a protrusion 6 radially projected from an outer surface of the sheath 5. In this embodiment, the protrusion 6 is extended over the whole length of the one cable 2*a*. A pair of the protrusions 6 are provided to be symmetrical with respect to a central axis of the one cable 2*a*. The pair of the protrusions 6 can abut against a shoulder 30 described later when the paired cable is inserted into a cutout described later.

The paired electrical cable 2 is used such that the one cable 2*a* transmits a first signal while the other cable 2*b* transmits a second signal which is opposite in phase to the first signal. Thereby, the paired electrical cable 2 reduces a noise generated by the pair of electrical cables 2*a* and 2*b*.

As shown in FIG. 1, the second paired electrical cable 3 has a pair of electrical cables 3*a* and 3*b* parallel to each other. Each of the cables 3*a* and 3*b* is a sheathed electrical cable having a wire core 7 and an insulating sheath 8 covering the wire core 7. The wire core 7 consists of an electrically conductive metal wires and the sheath 8 is made of a synthetic resin. One cable 3*a* has a diameter Ra (see FIG. 13) equal to that of the other cable 3*b*.

The one cable 3*a* is formed with a protrusion 9 radially projected from an outer surface of the sheath 8. In this embodiment, the protrusion 9 is extended over the whole length of the one cable 3*a*. A pair of the protrusions 9 is provided to be symmetrical with respect to a central axis of the one cable 3*a*. The pair of protrusions 9 can abut against another projection 33*b* described later when the one cable 3*a* is inserted into another cable receiving chamber 21*b* described later. The protrusion 9 corresponds to a second protrusion described in the summary of the invention.

The electrical connector 1 enables that the one cable 3*a* of the paired electrical cable 3 is electrically connected to the one cable 2*a* of the paired electrical cable 2, while the other cable 3*b* of the paired electrical cable 3 is electrically connected to the other cable 2*b* of the paired electrical cable 2. The one cable 3*a* transmits a first signal while the other cable 3*b* transmits a second signal which is opposite to the first signal in phase simultaneously to an optional electronic instrument mounted in the motor vehicle. Thereby, the paired electrical cable 3 can reduce a noise generated in the cables 3*a* and 3*b* due to the transmitted signals.

The one cable 2*a* transmits the first signal as well as the one cable 3*a* while the other cable 2*b* transmits the second signal as well as the other cable 3*b*.

Figure 2:
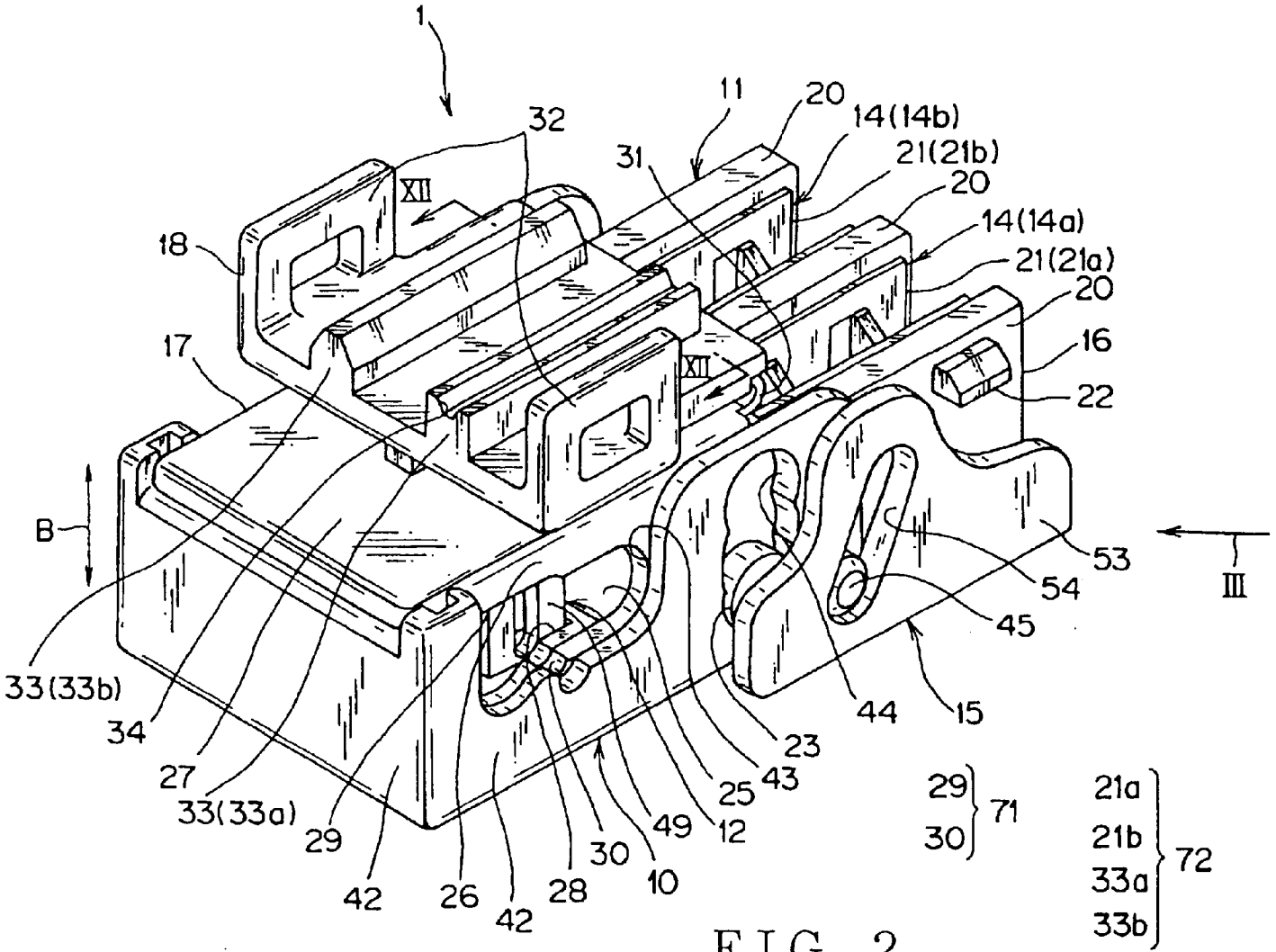
FIG. 2 is a perspective view showing a state in which the connector of FIG. 1 has not received electrical cables.
Figure 3:
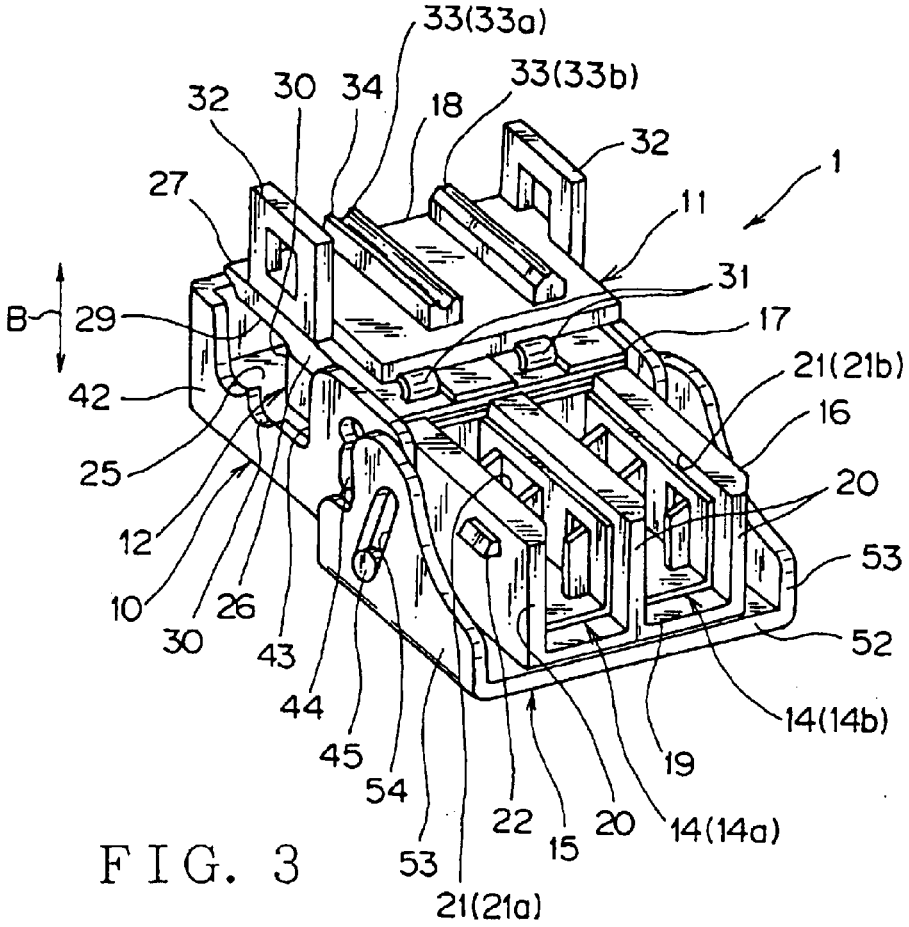
FIG. 3 is a perspective view taken along an arrow head III for showing the electrical connector of the FIG. 2.
Figure 4:
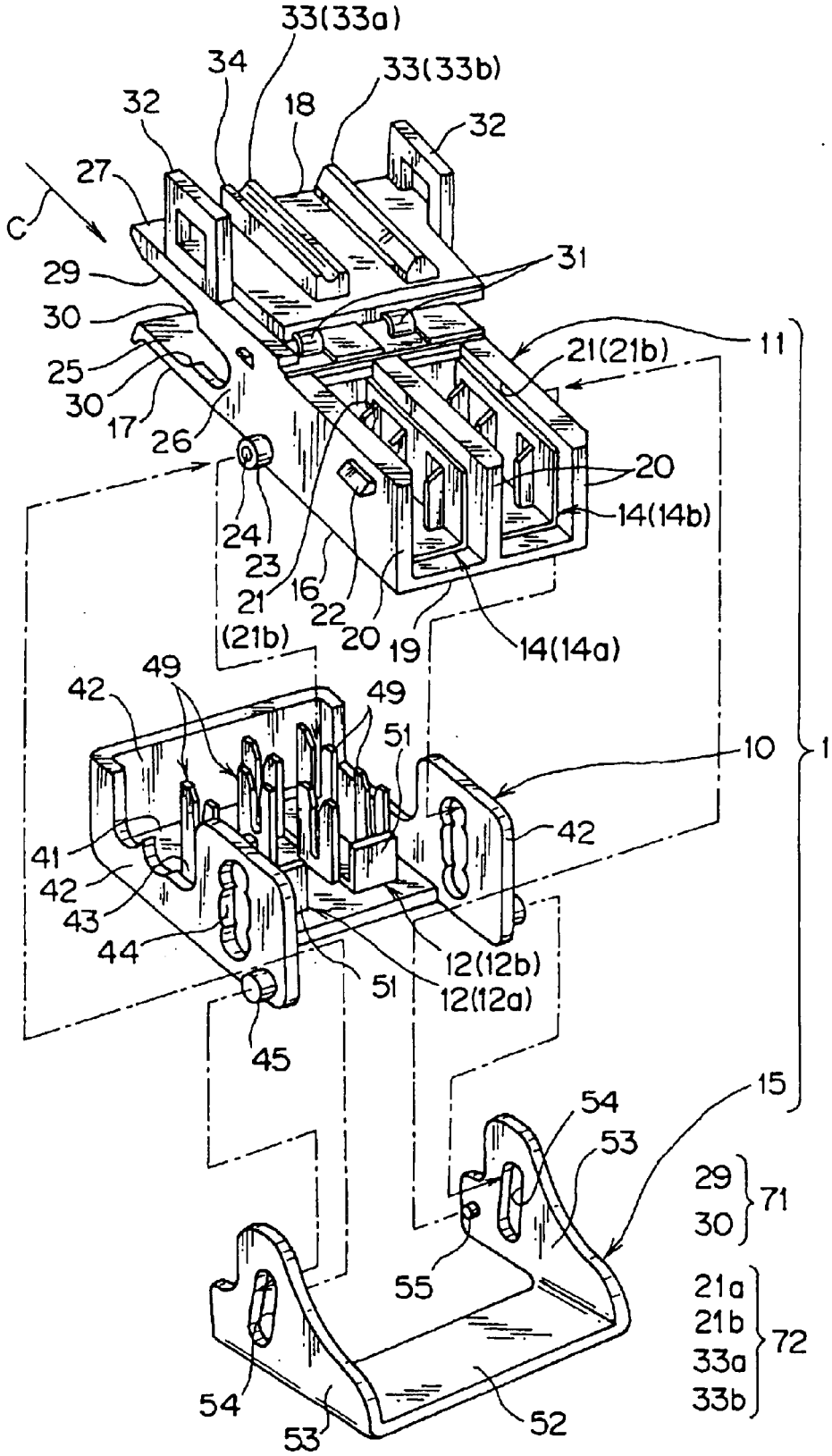
FIG. 4 is an exploded perspective view showing the electrical connector of the FIG. 3.

As illustrated in FIG. 1, the electrical connector 1 has a first connector housing 10, a pair of press-fit terminals 12 (terminal fittings) as shown in FIGS. 2 to 4, a second connector housing 11, a pair of press-fit terminals 14 as shown in FIGS. 2 to 4, and a lever 15.

As illustrated in FIG. 4, the first connector housing 10 has a wall 41 square in a plan view and three side walls 42. Each side wall 42 rises from an outer edge of the wall 41. On the wall 41, the press-fit terminals 12 are disposed so that the first connector housing 10 receives the press-fit terminals 12. Two of the side walls 42 are opposed to and spaced from each other, and each has a second cutout 43, an elongated hole 44, and a pivot projection 45. The second cutout 43 is cut out toward the wall 41 from an edge thereof.

The second cutout 43 of the first connector housing 10 is perpendicular to a cutout 29 described later of the second connector housing 11. As described later, when the first connector housing 10 comes close to a cable holding portion 17, the cutout 29 is incorporated with the second cutout 43 to surround the cables 2*a* and 2*b*.

The elongated direction of the hole 44 is perpendicular to the upper surface of the wall 41. The elongated hole 44 receives a sliding protrusion 23. The pivot projection 45 projects from an outer surface of the side wall 42 in an outward direction of the first connector housing 10.

The first connector housing 10 is coupled with the second connector housing 11 such that the wall 41 of the first connector housing 10 is parallel to walls 19 and 27 of the second connector housing 11, while the cable holding portion 17 of the electrical connector 1 is received inside the side walls 42. At the same time, the elongated hole 44 of the first connector housing 10 receives the sliding protrusion 23. Thereby, the first connector housing 10 is held by the second connector housing 11 slidably along a direction perpendicular to the upper surface of the wall 41.

The first connector housing 10 is slidable relative to the second connector housing 11 perpendicular (shown in FIG. 1) to a longitudinal direction of the cables 3*a* and 3*b* connected to the press-fit terminals 14 mounted in the second connector housing 11. That is, the first connector housing 10 can slide relative to the second connector housing 11 to come close to or away from the cable holding portion 17 of the second connector housing 11.

Figure 5:
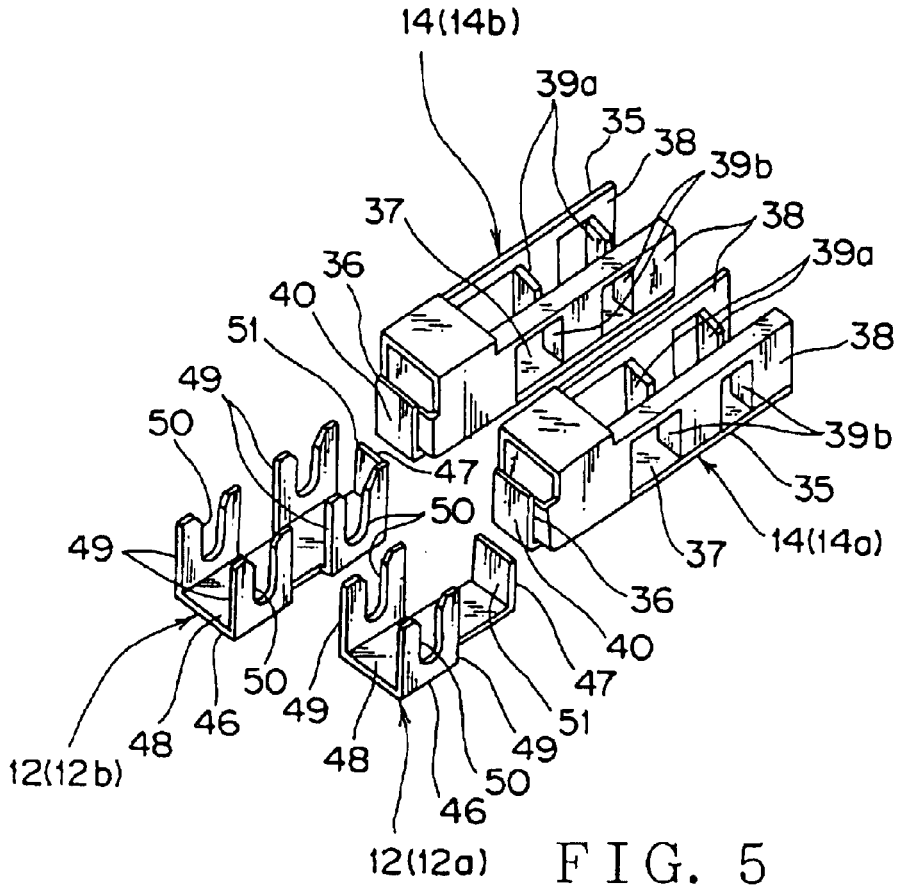
FIG. 5 is a perspective view showing press-fit terminals mounted in the electrical connector of the FIG. 1.

As illustrated in FIG. 5, the press-fit terminal 12 has a cable connection portion 46 and an electrical contact portion 47 electrically connected to the connection portion 46. The cable connection portion 46 has a bottom wall 48 and a plurality of press-fit blades 49, and the cables 2*a* or 2*b* are put on the bottom wall 48. The bottom wall 48 is rectangular in a plan view. The elongated direction of the bottom wall 48 is perpendicular to a longitudinal direction of the cable 2*a* or 2*b*.

The plurality of press-fit blades 49 rise each from a side edge of the bottom wall 48. The press-fit blade 49 is formed with a notch 50 for cutting the sheath 5 of the cable 2*a* or 2*b* for electrical connection with the wire core 4. The notch 50 cuts the press-fit blade 49 toward the bottom wall 48 from a free edge thereof. The cable connection portion. 46, that is, the press-fit terminal 12 fits to the cable 2*a* or 2*b* for electrical connection thereto.

The electrical contact portion 47 has a plate-shaped contact piece 51 contiguous with the cable connection portion 46. The contact piece 51 rises from the bottom wall 48. The contact piece 51 can be resiliently deflectable to face in a longitudinal direction of the cable 3*a* or 3*b* press-fitted to a cable connection portion 35 of the press-fit terminal 14.

Figure 6:
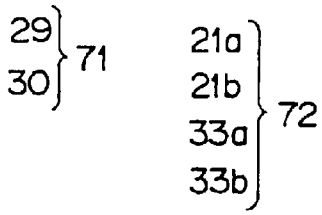
FIG. 6 is a sectional view showing a state in which a first connector housing is separated from a cable receiving space of a second connector housing with respect to the electrical connector of FIG. 1.
Figure 6:
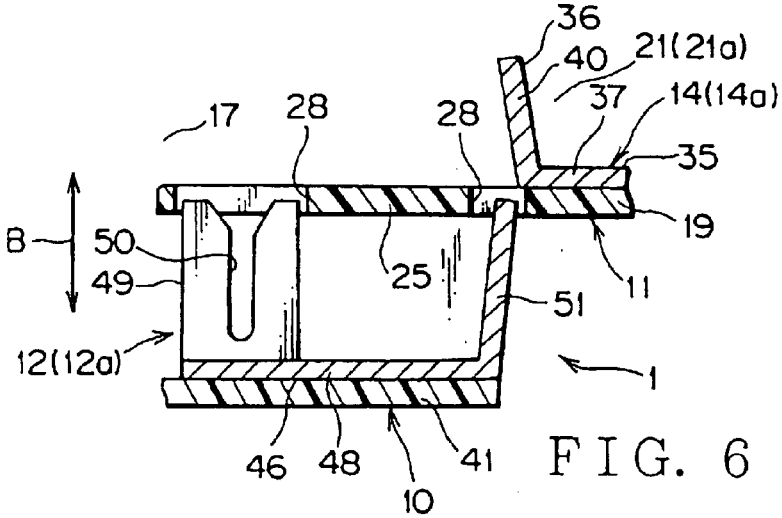

As illustrated in FIG. 6, the press-fit terminal 12 is put on the wall 41, of the first connector housing 10, while the contact piece 51 is positioned near a contact piece 40 (described later) of the press-fit terminal 14 mounted in the second connector housing 11. Then, the first connector housing 10 slides toward the cable holding portion 17, so that the press-fit blades 49 gradually advance into the cable holding portion 17.

Furthermore, a press-fit terminal 12*a*, which is one of the pair of the press-fit terminals 12 and is positioned in a left side in FIG. 4, has the press-fit blade 49 that is positioned at a middle of the cutout 29 when the first connector housing 10 slides toward the cable holding portion 17. Meanwhile, the other press-fit terminal 12*b*, which is positioned in a right side in FIG. 4, has press-fit blades 49 each facing toward each end side of the cutout 29 when the first connector housing 10 slides toward the cable holding portion 17. The press-fit terminals 12*a* and 12*b* correspond sequentially to the first and second terminal fitting described in the summary of the invention.

The second connector housing 11 is generally cylindrical and is made of an insulating synthetic resin material. As illustrated in FIGS. 1 to 4, the second connector housing 11 has a cable securing portion 16 and a cable holding portion 17. The cable securing portion 16 consists of a wall 19 retaining the press-fit terminal 14, three vertical walls 20 raised from the wall 19, and a cover 18.

The vertical walls 20 are parallel disposed with a uniform space therebetween. Outer two of the vertical walls 20 constitute an outer shell of the cable securing portion 16, i.e. of the second connector housing 11, each of which is formed with an engagement protrusion 22 and a sliding protrusion 23.

Each of the engagement protrusion 22 and the sliding protrusion 23 projects outward from the second connector housing 11. The sliding protrusion 23 is positioned at an end of the cable securing portion 16 near the cable holding portion 17. The sliding protrusion 23 is positioned at an end side of the cable securing portion 16 away from the cable holding portion 17. The sliding protrusion 23 is formed with a dent 24 (see FIG. 4) at a tip end thereof. The engagement protrusion 22 is positioned an end of the vertical wall 20 in a side opposite to the cable receiving portion 17.

The cover 18 is coupled to the cable holding portion 17 via hinges 31. The hinges 31 are fitted to the wall 27. The cover 18 is a flat plate. The cover 18 is pivotable relative to the wall 19 via the hinges 31 toward and away from the vertical walls 20. The cover 18 has a pair of locking arms 32 engageable with the engagement protrusions 22. The cover 18 pivots around the hinges 31 to be overlaid on the wall 27 as illustrated in FIG. 2 and to be opposed to the wall 19 with the locking arm 32 being engaged with the engagement protrusion 22 as illustrated in FIG. 1.

With the locking arm 32 being engaged with the engagement protrusion 22, the vertical walls 20 and the cover 18 define an enclosed space which constitutes a pair of the cable receiving chambers 21. Each of the cable receiving chambers 21 is straight and parallel to each other. One cable receiving chamber 21*a* positioned in a left side of FIG. 1 receives a press-fit terminal 14*a* described later, while the other cable receiving chamber 21*b* positioned in a right side of FIG. 1 receives a press-fit terminal 14*b* described later. The press-fit terminals 14*a* and 14*b* fit the cables 3*a* and 3*b* respectively. The cable receiving chambers 21*a* and 21*b* receive the cables 3*a* and 3*b* respectively. Meanwhile, the cable securing portion 16 holds the cables 3*a* and 3*b*.

In this specification, the engagement completion of the locking arm 32 with the paired electrical cable 2 means that the cable receiving chambers 21*a* and 21*b* have received the cables 3*a* and 3*b*.

Figure 12:
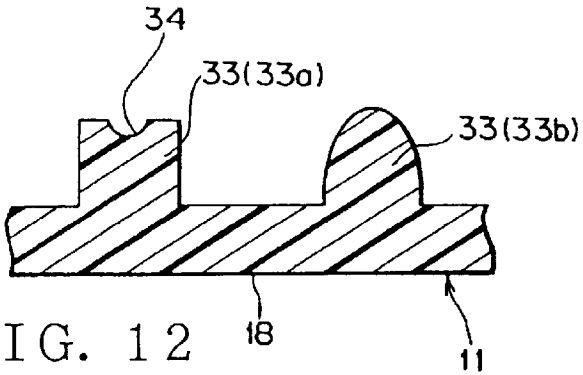
FIG. 12 is a sectional view taken along line XII—XII of FIG. 2.

The cover 18 has a pair of projections 33 on a surface of the cover 18. The projections 33 are located between the vertical walls 20 where the cover 18 is opposed to the wall 19 with a space therebetween. Thus, the projections 33 advance inside the cable receiving chambers 21*a* and 21*b*. One projection 33*a* of the projections 33, which is positioned in the one cable receiving chamber 21*a*, has a groove 34 formed at an end thereof as illustrated in FIGS. 1 and 12. The groove 34 is formed over the whole length of the one projection 33*a*. Into the groove 34, the protrusion 6 of the one cable 3*a* can be inserted, while the locking arm 32 of the cover 18 can engage with engagement protrusion 22.

Thus, the one projection 33*a* allows that the press-fit terminal 14*a* fits the one cable 3*a* for electrical connection therebetween.

The other projection 33, which is designated by reference numeral 33*b*, is positioned in the other cable receiving chamber 21*b*, and the other projection 33*b* prevents the locking arm 32 from engaging with the engagement protrusion 22 when the press-fit terminal 14*b* will undesirably press-fit the one cable 3*a*, since the other projection 33*b* interferes with the protrusion 6. That is, the other projection 33*b* prevents the other cable receiving chamber 21*b* from receiving the one cable 3*a* so that the one cable 3*a* can not connect electrically to the other cable 2*b*.

Meanwhile, the pair of projections 33*a* and 33*b* allow the locking arm 32 to engage with the engagement protrusion 22 when the other cable 3*b* is received in the cable receiving chambers 21*a* and 21*b*. That is, the pair of projections 33*a* and 33*b* allow the cable receiving chambers 21*a* and 21*b* to receive the other cable 3*b*.

Thus, the pair of projections 33*a* and 33*b* can select the arrangement of the cables 3*a* and 3*b* within the cable receiving chambers 21 to hold the cables 3*a* and 3*b* in the second connector housing 11.

The cable receiving chambers 21*a* and 21*b* constitute a second cable distinction device 72 described in the summary of the invention together with the pair of projections 33*a* and 33*b*. The pair of projections 33*a* and 33*b* correspond to the projections described in the summary of the invention.

The cable holding portion 17 is contiguous with the cable securing portion 16 in a longitudinal direction of the cable receiving chamber 21. The cable holding portion 17 has a wall 25 contiguous with the wall 19, a pair of side walls 26, and a wall 27 spaced oppositely from the wall 25, defining a cylindrical shape.

The wall 25 is formed with through holes 28 (see FIG. 2) passing the blade 49 of the press-fit terminal 12 mounted in the first connector housing 10. The pair of side walls 26 rises from the wall 25 to be contiguous with the peripheral vertical walls 20 of the cable securing portion 16. Each side wall 26 is formed with the cutout 29.

The cutout 29 cuts the side wall 26 toward the cable securing portion 16 to define a recess in a side view thereof. The cutout 29 has an elongated distance in a longitudinal direction of the cables 3*a* and 3*b* fitted to the press-fit terminals 14 received in the cable securing portion 16. Through the cutout 29, the paired electrical cable 2 consisting of the cables 2*a* and 2*b* is inserted into the cable securing portion 16 along an arrow head C as illustrated in FIG. 4. The arrow head C shows an insertion direction of the pair of cables 2*a* and 2*b* through the cutout 29.

The cutout 29 is formed with the shoulder 30 at a middle of an inner periphery thereof in a direction perpendicular to the arrow head C direction, the shoulder 30 being able to abut against the protrusion 6 of the one cable 2*a*. The shoulder 30 prevents the one cable 2*a* from advancing within the cutout 29. Meanwhile, the shoulder 30 allows the other cable 2*b* to advance within the cutout 29 over the shoulder. The cable holding portion 17 has the wall 27 parallel to the wall 25 and is contiguous with the pair of side walls 26.

The cable holding portion 17 can receive the cables 2*a* and 2*b* between the walls 25 and 27 through the cutout 29. The cables 2*a* and 2*b*, which are received in the cable holding portion 17 through the cutout 29, are perpendicular to a longitudinal direction of the cables 3*a* and 3*b* connected to the press-fit terminals 14. That is, the cable holding portion 17 holds the cables 2*a* and 2*b* which are perpendicular to the cables 3*a* and 3*b*.

The cutout 29 having the shoulder 30 correctly guides the paired electrical cable 2 consisting of the cables 2*a* and 2*b* such that the one cable 2*a* is fitted to the one press-fit terminal 12*a* and the other cable 2*b* is fitted to the other press-fit terminal 12*b*. Because, the shoulder 30 positions the one cable 2*a* in a middle of the cutout 29 in the arrow head C direction, so that the other cable 2*b* is positioned in an inner or outer side of the one cable 2*a* in the arrow head C direction. Furthermore, the one press-fit terminal 12*a* is positioned to contact with an electrical cable located in the middle of the cutout 29 in the arrow head C direction, while the other press-fit terminal 12*b* is positioned to contact with an electrical cable located in an inner or outer side of the shoulder 30 in the arrow head C direction.

The cutout 29 having the shoulder 30 constitutes a cable distinction device 71, and the first and second connector housings constitute the connector 1 generally.

As illustrated in FIG. 5, the press-fit terminal 14 has a cable connection portion 35 and an electrical contact portion 36 electrically connectable to the press-fit terminal 12. The cable connection portion 35 has a bottom wall 37 on which the cables 3*a* and 3*b* are retained, a pair of side walls 38, and plural pairs of press-fit blades 39*a* and 39*b*. The bottom wall 37 is rectangular in a plan view thereof, and the cables 3*a* and 3*b* are longitudinally retained along an elongated direction of the bottom wall 37.

The pair of side walls 38 rise from each side edge of the bottom wall 37 to be opposed to each other. The pair of press-fit blades 39*a* and 39*b* are extended from one of the side walls 38 and receive the cable 3*a* or 3*b*. The pair of press-fit blades 39*a* and 39*b* can cut the sheath 5 of the cable 3*a* or 3*b* to contact with the wire core 4 of the electrical cable. Thereby, the press-fit terminal 14 of the cable connection portion 35 electrically connects to the wire core 4 of the cable 3*a* or 3*b*.

The electrical contact portion 36 has a plate-shaped contact piece 40 continuous with the cable connection portion 35. The contact piece 40 rises from the bottom wall 37, and a free end of the electrical contact portion 36 can resiliently deflect generally in a longitudinal direction of the cable 3*a* or 3*b*.

One of the press-fit terminals 14, identified as 14*a*, which is positioned in a left side in FIG. 4, is received in the one cable receiving chamber 21*a* of the cable securing portion 16 of the second connector housing 11. The other, as identified as 14*b*, which is positioned at right side in FIG. 4, is received in the other cable receiving chamber 21*b*. Thereby, the press-fit terminals 14 are retained in the second connector housing 11.

Figure 7:
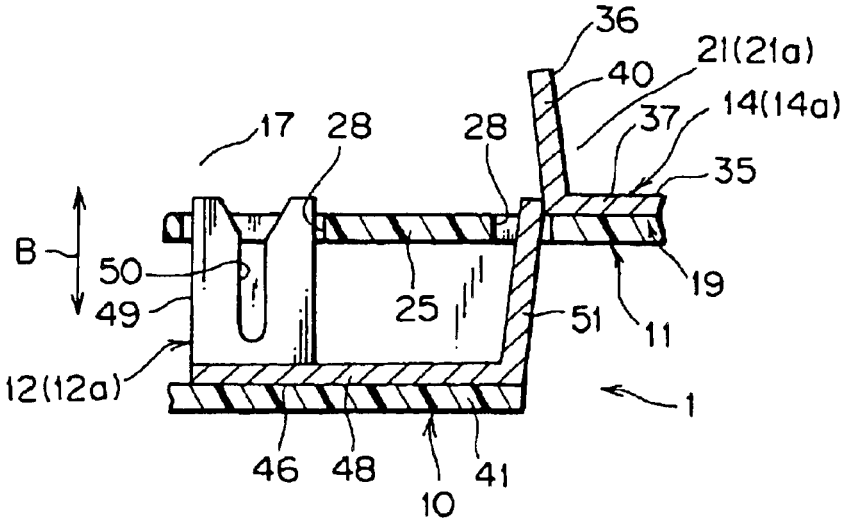
FIG. 7 is a sectional view showing a state in which the first connector housing is slid toward the cable receiving space from the state of FIG. 6.

Each of the cables 3*a* and 3*b* is pressed against a pair of press-fit blades 39*a* and 39*b* so that the press-fit blades 39*a* and 39*b* cut into the sheath 5 of the electrical cable to electrically connect to the wire core 4 of the cable. The one press-fit terminal 14*a* electrically connects to the one cable 3*a*, while the other press-fit terminal 14*b* electrically connects to the other cable 3*b*. As illustrated in FIG. 7, the contact piece 40 contacts the contact piece 51 of the press-fit terminal 12*a* or 12*b* retained in the first connector housing 10 when the first connector housing 10 is moved toward the cable holding portion 17.

Figure 8:
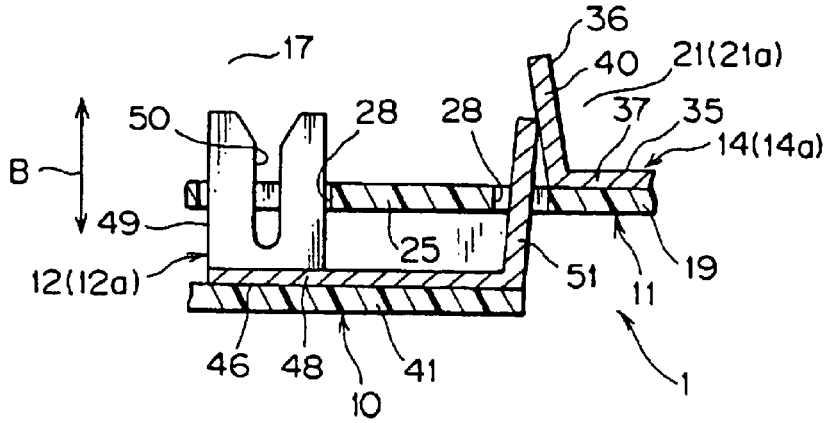
FIG. 8 is a sectional view showing a state in which the first connector housing is further slid toward the cable receiving space from the state of FIG. 7.

A further movement of the first connector housing 10 toward the cable holding portion 17 resiliently deflects the contact pieces 40 and 51 to push each other more strongly as illustrated in FIG. 8. The complete insertion of the press-fit blade 49 into the cable holding portion 17 surely contacts the contact piece 40 with the contact piece 51 in a longitudinal direction of the cables 3*a* and 3*b* inserted into the second connector housing 11.

Figure 9:
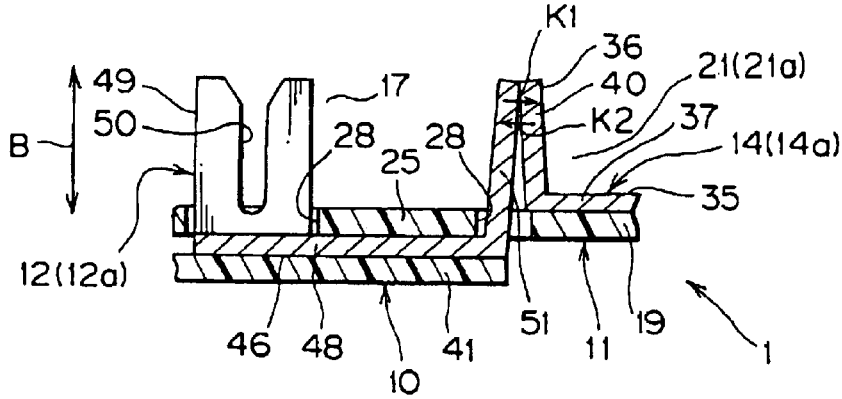
FIG. 9 is a sectional view showing a state in which the first connector housing is completely slid toward the cable receiving space from the state of FIG. 8.

As illustrated in FIG. 9, the contact pieces 40 and 51 exert resilient forces to each other in a direction K1 or K2. Thus, the one press-fit terminal 14*a* electrically contacts the one press-fit terminal 12*a* while the other press-fit terminal 14*b* electrically contacts the other press-fit terminal 12*b*.

Figure 16:
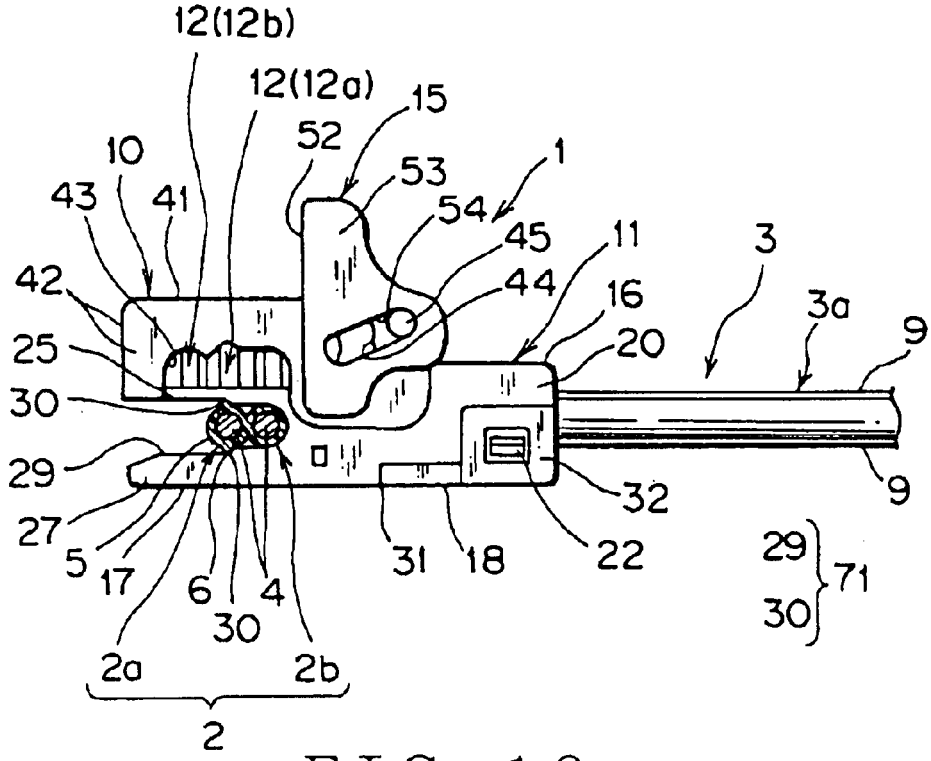
FIG. 16 is a side view showing a state in which the first pair electrical cable is moved into the cable receiving space of the connector from the state of FIG. 15.
Figure 18:
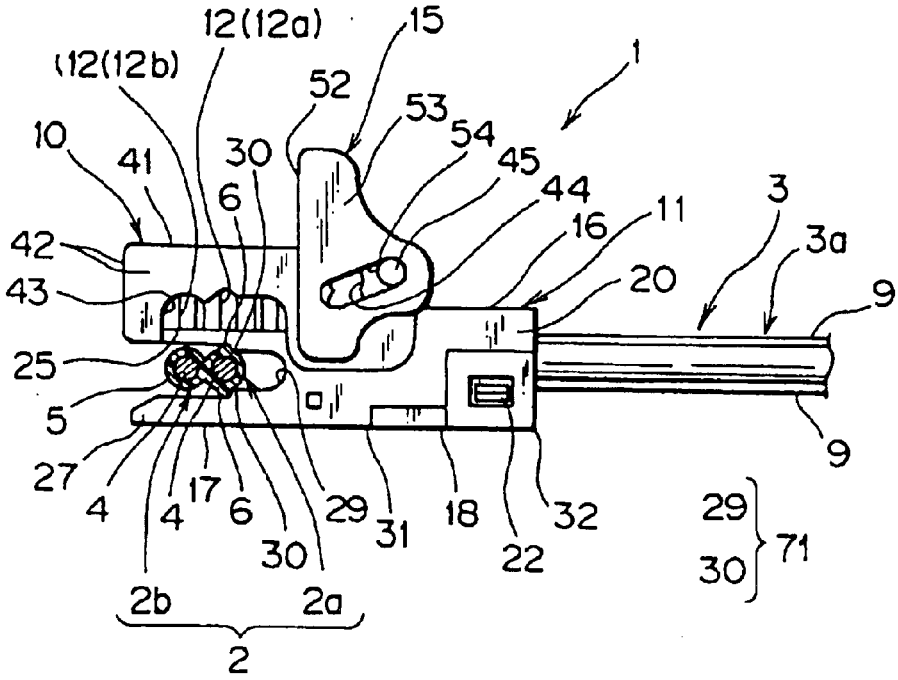
FIG. 18 is a side view showing a state in which the first pair electrical cable is moved into the cable receiving space of the connector shown in FIG. 11, and a first electrical cable is positioned inward from a second cable within the cable receiving space regarding the first paired cable.

In detail, before the wall 41 of the first connector housing 10 moves toward the wall 25 of the cable holding portion 17, the cables 2*a* and 2*b* are inserted into the cable holding portion 17 through the cutout 29. The cables 2*a* and 2*b* are perpendicular to the cables 3*a* and 3*b* in longitudinal directions thereof. The one cable 2*a* abuts against the shoulder 30 to position at the middle of the cutout 29. The other cable 2*b* is positioned in a side of the cable securing portion 16 relative to the one cable 2*a* as illustrated in FIG. 16 or is positioned in an opposite side of the cable securing portion 16 relative to the one cable 2*a* as illustrated in FIG. 18.

The movement of the first connector housing 10 toward the cable holding portion 17 contacts the pieces 40 and 51 with each other by resilient abutting forces therebetween. Furthermore, the one cable 2*a* fits to the blade 49 of the one press-fit terminal 12*a* while the other cable 2*b* fits to the blade 49 of the other press-fit terminal 12*b*. Thus, the one cable 3*a* electrically connects to the one cable 2*a* via the press-fit terminal 14*a* and the one press-fit terminal 12*a*, while the other cable 3*b* electrically connects to the other cable 2*b* via the press-fit terminal 14*b* and the other press-fit terminal 12*b*.

The lever 15 has a wall 52 rectangular in a plan view thereof and a pair of side walls 53. The side walls 53 rise from a side edge of the wall 52 to be opposed to each other. Each side wall 53 is formed with a protrusion 55 (only one of them is illustrated in FIG. 4) and an elongated hole 54. The protrusion 55 is positioned at an end of the side wall 53 and can engage with a dent 24 formed in the sliding protrusion 23. The engagement of the protrusion 55 with the dent 24 of the sliding protrusion 23 makes the second connector housing 11 support the lever 15 such that the lever 15 can pivot around the protrusion 55. The elongated hole 54 is positioned at a middle of the side wall 53 to receive outwardly the pivot projection 45 of the first connector housing 10.

Figure 14:
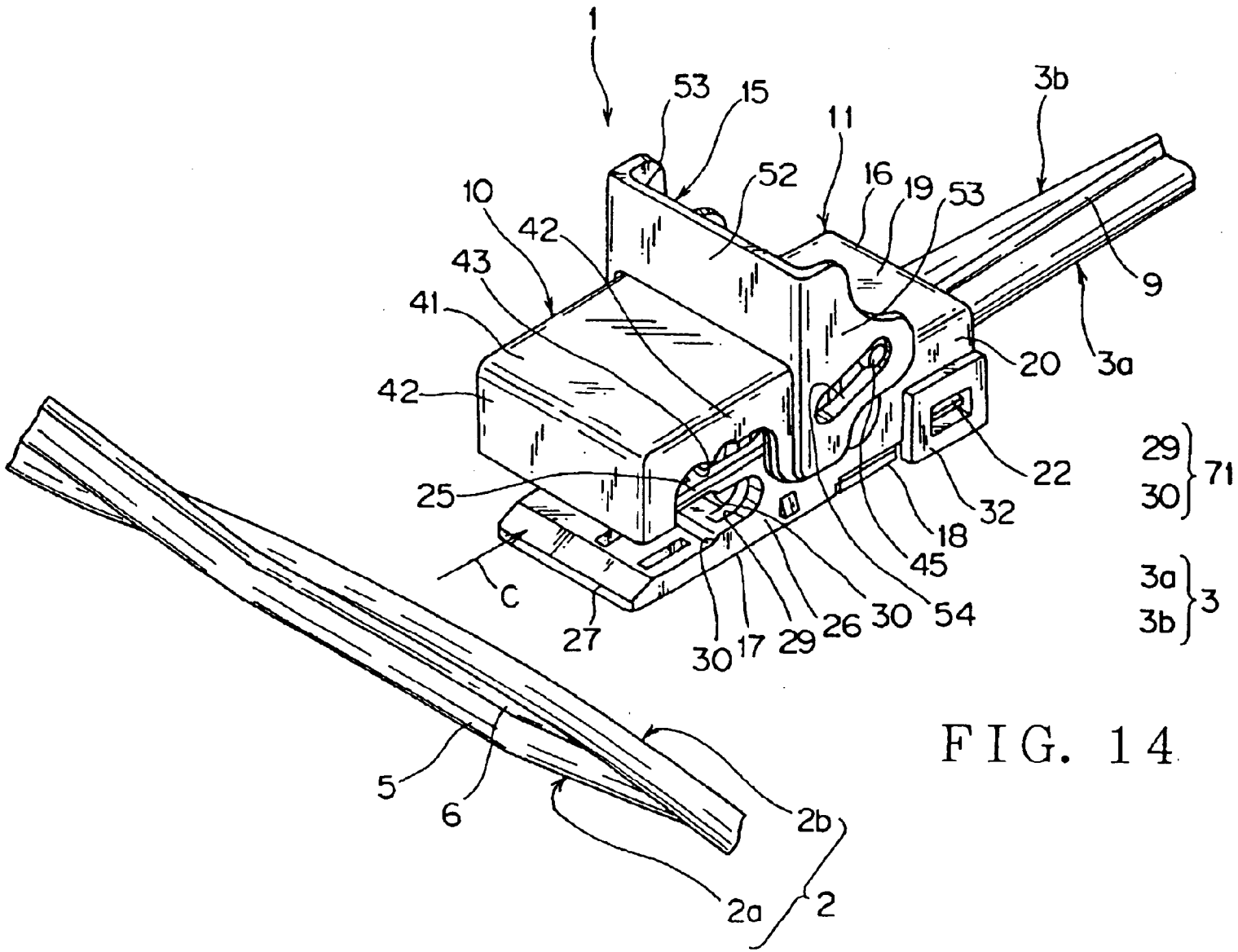
FIG. 14 is a perspective view showing a state in which the connector of FIG. 11 is going to be moved toward a first pair connector cable, the connector having fitted with the second pair of electrical cable.

As illustrated in FIG. 14, when the lever 15 is positioned such that the wall 52 is perpendicular to the walls 19 and 25 of the second connector housing 11, the engagement position of the pivot projection 45 within the elongated hole 54 keeps the first connector housing 10 apart from the cable holding portion 17. As illustrated in FIG. 1, when the lever 15 is positioned such that the wall 52 is parallel to the walls 19 and 25 of the second connector housing 11, the engagement position of the pivot projection 45 within the elongated hole 54 keeps the first connector housing 10 near the cable holding portion 17. That is, the pivoting of the lever 15 can move the first connector housing 10 toward and apart from the cable holding portion 17 of the second connector housing 11.

For assembling the connecter 1, first, the press-fit terminals 14*a* and 14*b* are inserted between adjacent vertical walls 20 of the second connector housing 11. The press-fit terminals 12*a* and 12*b* are fitted on the wall 41 of the first connector housing 10. The elongated hole 44 of the first connector housing 10 receives the sliding protrusion 23 so that the first connector housing 10 is coupled to the second connector housing 11. Then, the protrusion 55 of the lever 15 is engaged with the dent 24 of the sliding protrusion 23 of the second connector housing 11, while the elongated hole 54 receives the pivot projection 45. Thereby, the lever 15 is coupled to the connector housings 10 and 11.

Figure 10:
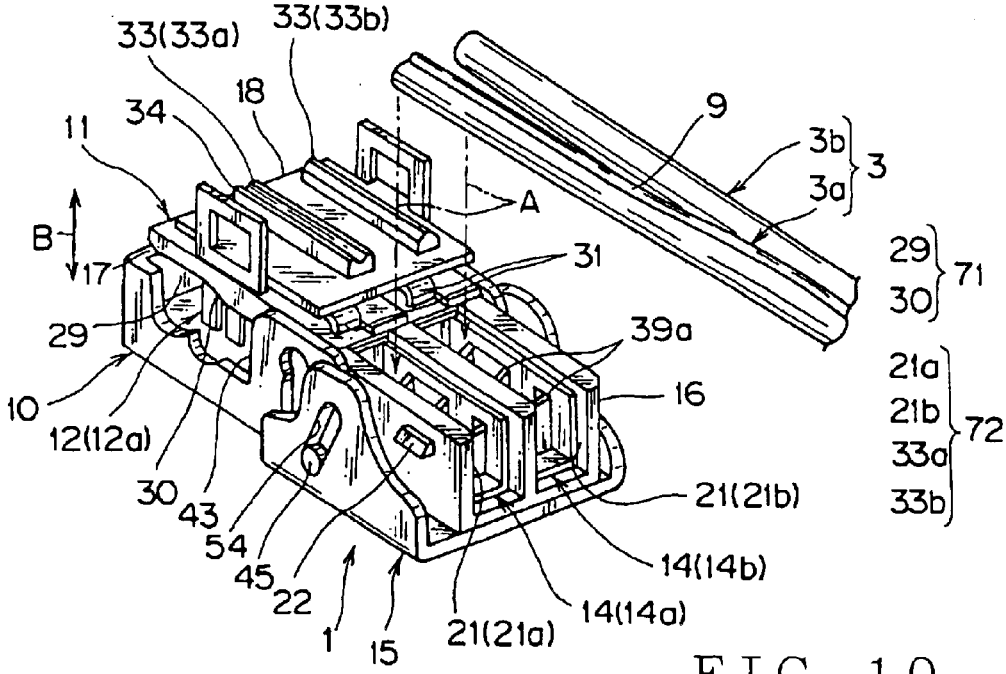
FIG. 10 is a perspective view showing a state in which a second pair electrical cable is going to be fitted to the press-fit terminals of the connector of FIG. 3.

With the use of the connector 1 for electrically connecting the paired electrical cable 2 to an additional electronic instrument mounted on a motor vehicle, first, the cables 3*a* and 3*b* of the paired electrical cable 3 are fitted to the press-fit terminals 14*a* and 14*b*. The cables 3*a* and 3*b* are electrically connected to the additional electronic instrument. As illustrated in FIG. 10, each of the cables 3*a* and 3*b* is pressed between a pair of the press-fit blades 39*a* and 39*b* of the press-fit terminals 14*a* or 14*b* in an arrow head A direction so that the press-fit terminals 14*a* and 14*b* fit the cables 3*a* and 3*b*.

Figure 13:
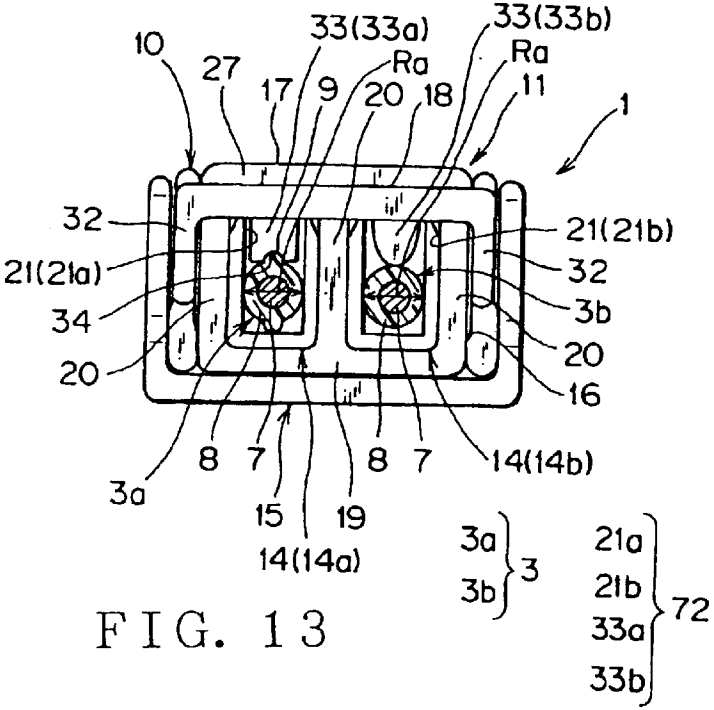
FIG. 13 is a sectional view taken along line XIII—XIII of FIG. 11.
Figure 11:
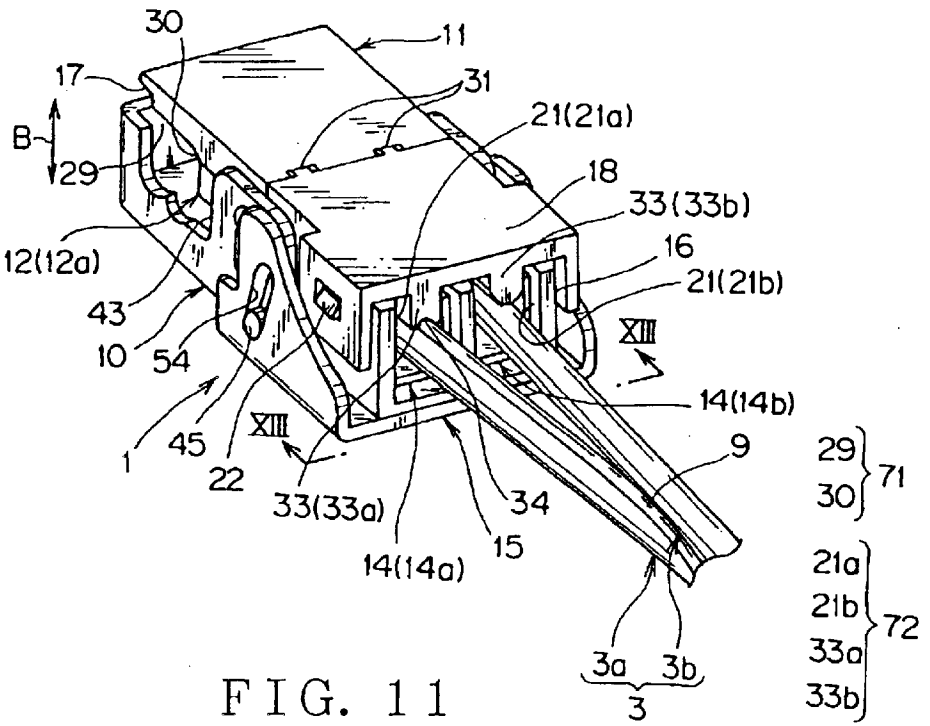
FIG. 11 is a perspective view showing a state in which the second pair electrical cable is fitted to the connector of FIG. 3.

Then, the turning of the cover 18 around the hinges 31 engages the locking arm 32 with the engagement protrusion 22 as illustrated in FIG. 11. In this state, as illustrated in FIG. 13, the one projection 33*a* has advanced into the one cable receiving chamber 21*a* which has received the press-fit terminal 14*a* connected to the one cable 3*a*. The groove 34 of the one projection 33*a* has engaged with the protrusion 6 of the one cable 3*a*. The other projection 33*b* has advanced into the other cable receiving chamber 21*b* which has received the press-fit terminal 14*b* connected to the other cable 3*b*.

When the other projection 33*b* interferes with the protrusion 6 of the one cable 3*a* so that the locking arm 32 of the cover 18 can not engage with the engagement protrusion 22, the cables 3*a* and 3*b* are removed from the press-fit terminals 14*a* and 14*b*. The cables 3*a* and 3*b* are fitted again to press-fit terminals 14*a* and 14*b* in another sequential arrangement within the second connector housing 11.

Thus, the second cable distinction device 72 can surely position the one cable 3*a* in the one cable receiving chamber 21*a* mounted with the press-fit terminal 14*a* connected to the one press-fit terminal 12*a*. Meanwhile, the other cable 3*b* is surely positioned in the other cable receiving chamber 21*b* mounted with the press-fit terminal 14*b* connected to the other press-fit terminal 12*b*.

As illustrated in FIGS. 14 and 15, the first connector housing 10 keeps apart from the cable holding portion 17 by positioning the lever 15 such that the wall 52 is perpendicular to the walls 19 and 25 of the second connector housing 11.

Then, the electrical connector 1, which has received the cables 3*a* and 3*b*, is moved such that the cable holding portion 17 of the second connector housing 11 faces the paired electrical cable 2 that has been arranged on the vehicle. The cables 2*a* and 2*b* of the paired electrical cable 2 are inserted into the cutout 29, i.e., into the cable holding portion 17. The protrusion 6 of the one cable 2*a* abuts against the shoulder 30, so that the one cable 2*a* is positioned at the middle of the cutout 29 as illustrated in FIG. 16. The other cable 2*b* is positioned in a side away from the cable securing portion 16 relative to the one cable 2*a* as illustrated in FIG. 18.

The lever 15 is turned until the wall 52 is overlaid on the vertical wall 20 of the cable securing portion 16. Thereby, the pivot projection 45 moves within the elongated hole 54 so that the first connector housing 10 slides toward the cable holding portion 17. That is, through the through hole 28 of the wall 25 of the cable holding portion 17, the press-fit blades 49 of the press-fit terminals 14*a* and 14*b* advance into the cable holding portion 17 while the contact pieces 40 of the press-fit terminals 14*a* and 14*b* come toward the contact pieces 51 of the press-fit terminals 12*a* and 12*b*.

Figure 17:
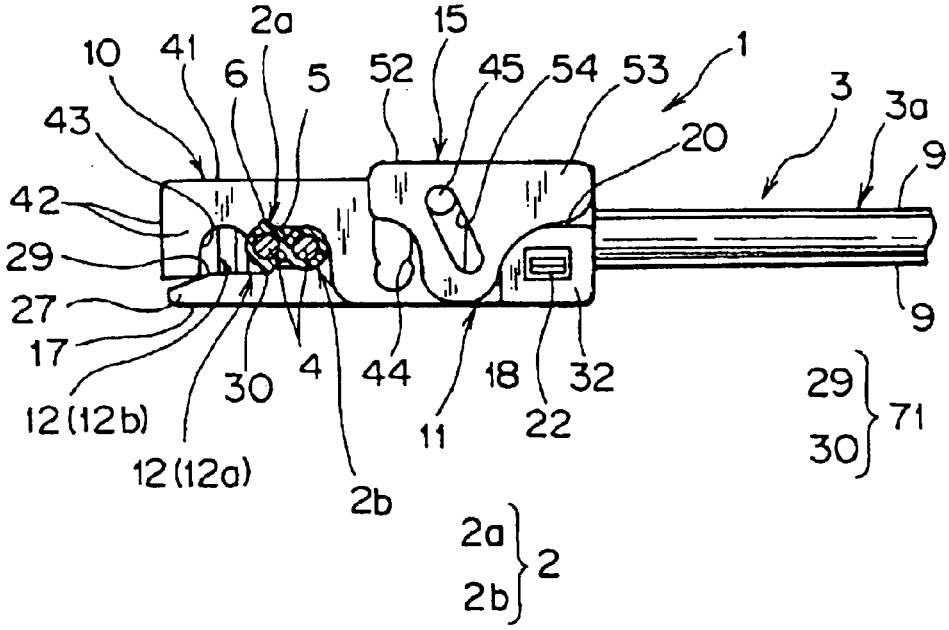
FIG. 17 is a side view showing a state in which the first connector housing is moved to the cable receiving space of the connector from the state of FIG. 16 by pivoting a lever member.
Figure 19:
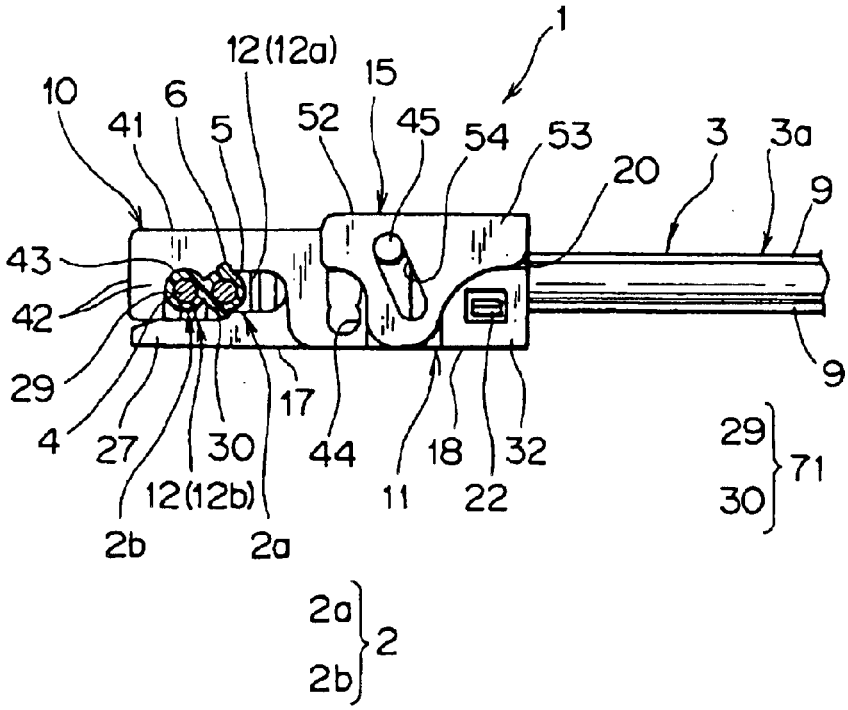
FIG. 19 is a side view showing a state in which the first connector housing is moved to the cable receiving space of the connector from the state of FIG. 18 by pivoting the lever member.

Finally, the press-fit blades 49 of the press-fit terminals 12*a* and 12*b* are correctly fitted to the cables 2*a* and 2*b*, while the pieces 40 and 51 contact each other with resilient abutment forces thereof. As illustrated in FIG. 17 or 19, the wall 52 of the lever 15 overlays the vertical wall 20 of the cable securing portion 16.

Thus, the one cable 3*a* electrically connects the one cable 2*a* while the other cable 3*b* electrically connects the other cable 2*b*. Accordingly, the additional electronic instrument is electrically connected to the cables 2*a* and 2*b* which have been arranged previously.

In the embodiment, the cable distinction device 71 guides the pair of cables 2*a* and 2*b* such that the one cable 2*a* electrically connects to the one cable 3*a* while the other cable 2*b* electrically connects to the other cable 3*b*. The sliding movement of the first connector housing 10 toward the cable holding portion 17 enables that the one press-fit terminal 12*a* electrically connects to the press-fit terminal 14*a* while the other press-fit terminal 12*b* electrically connects to the press-fit terminal 14*b*.

Since the one press-fit terminal 12*a* is fitted to the one cable 3*a* associated with the one cable 2*a* while the other press-fit terminal 12*b* is fitted to the other cable 3*b* associated with the other cable 2*b*, the cables 2*a* and 3*a* electrically connect each other while the cables 2*b* and 3*b* electrically connect each other.

Furthermore, the cable distinction device 71 guides the pair of cables 2*a* and 2*b* such that the one cable 2*a* electrically connects to the one press-fit terminal 12*a* while the other cable 2*b* electrically connects to the other press-fit terminal 12*b*. Thus, the cables 2*a* and 3*a* electrically connect each other while the cables 2*b* and 3*b* electrically connect each other with ease.

The second cable distinction device 72 prevents the one cable 3*a*, which has been fitted to the press-fit terminal 14*b*, from being received in the other cable receiving chamber 21*b*. Meanwhile, the second cable distinction device 72 allows the one cable 3*a*, which has been fitted to the press-fit terminal 14*a*, to be received in the one cable receiving chamber 21*a*. Thus, the second cable distinction device 72 prevents the one cable 3*a* from electrically connecting to the other cable 2*b* but allows the one cable 3*a* to electrically connect to the one cable 2*a*.

Thus, the one cable 3*a*, which has been fitted to the press-fit terminal 14*a*, is correctly received in the one cable receiving chamber 21*a*, and the other cable 3*b*, which has been fitted to the press-fit terminal 14*b*, is correctly received in the other cable receiving chamber 21*b*. Accordingly, the cables 2*a* and 3*a* electrically connect each other while the cables 2*b* and 3*b* electrically connect each other, so that the paired electrical cable 2 is electrically connected to the paired electrical cable 3 correctly.

Furthermore, the shoulder 30 prevents the one cable 2*a* from reaching an inner end of the cutout 29 but allows the other cable 2*b* to reach the inner end of the cutout 29 because, the one cable 2*a* has the protrusion 6 abutting against the shoulder 30. Thus, the insertion of the pair of cables 2*a* and 2*b* into the cutout 29 correctly positions the cables 2*a* and 2*b*, so that the one cable 2*a* is surely fitted to the one press-fit terminal 12*a* while the other cable 2*b* is surely fitted to the other press-fit terminal 12*b*.

The other projection 33*b* prevents the one cable 3*a* from being received in the other cable receiving chamber 21*b* while the one projection 33*a* allows the one cable 3*a* to be received in the other cable receiving chamber 21*b*. Thus, the one cable 3*a* is distinguished from the other cable 3*b*.

That is, by means of the projections 33*a* and 33*b*, the one cable 3*a* is received in the one cable receiving chamber 21*a* while the other cable 3*b* is received in the other cable receiving chamber 21*b*. Accordingly, the associating cables 2*a* and 3*a* electrically connect surely each other while the associating cables 2*b* and 3*b* electrically connect surely each other. The paired electrical cables 2 and 3 electrically connect surely each other.

The one cable 3*a* has the protrusion 9 interfering with the other projection 33*b* so that the one cable 3*a* is distinguished from the other cable 3*b*. Thereby, the one cable 3*a* is received in the one cable receiving chamber 21*a* while the other cable 3*b* is received in the other cable receiving chamber 21*b*. Accordingly, the associating cables 2*a* and 3*a* electrically connect surely each other while the associating cables 2*b* and 3*b* electrically connect surely each other. The paired electrical cables 2 and 3 electrically connect surely each other. By the cable distinction devices 71 and 72, the paired electrical cables 2 and 3 electrically connect each other to define a desired pattern, preventing incorrect electrical connection of the paired electrical cables 2 and 3. The cable distinction device 71 and 72 allow an electrical connection work in a blind space.

With the cables 2*a* and 2*b* being held by the cable holding portion 17, the first connector housing 10 slides toward the cable holding portion 17 so that the press-fit terminals 12*a* and 12*b* are fitted to the cables 2*a* and 2*b*. The cables 3*a* and 3*b* electrically connect correctly to the cables 2*a* and 2*b* with ease. The second connector housing 11 has the cutout 29 that receives the cables 2*a* and 2*b* with ease. The cable holding portion 17 can hold the cables 2*a* and 2*b* which are positioned generally perpendicular to the cables 3*a* and 3*b*.

The first connector housing 10 has the second cutout 43 opened to a sliding direction of the second connector housing 11. The sliding direction of the first connector housing 10 is perpendicular to the opening direction of the cutout 29 of the cable holding portion 17. The sliding movement of the first connector housing 10 toward the cable holding portion 17 fits the press-fit terminals 12*a* and 12*b* to the cables 2*a* and 2*b*, while the cutouts 29 and 43 surround the cables 2*a* and 2*b*. Thereby, the cables 2*a* and 2*b* electrically connect each other without undesirable disengagement of the cables 2*a* and 2*b* from the cable holding portion 17.

The contact piece 40 of the press-fit terminal 14*a* or 14*b* contacts the contact piece 51 of the press-fit terminal 12*a* or 12*b* in a longitudinal direction thereof with a resilient force therebetween. The sliding movement of the first connector housing 10 toward the cable holding portion 17 connects the press-fit terminals 14*a* and 14*b* to the press-fit terminals 12*a* and 12*b*, so that the cables 3*a* and 3*b* electrically connect surely to the cables 2*a* and 2*b*.

The pivoting of the lever 15 slides the first connector housing 10 so that the press-fit terminals 12*a* and 12*b* electrically connect correctly the cables 2*a* and 2*b*.

Figure 20:
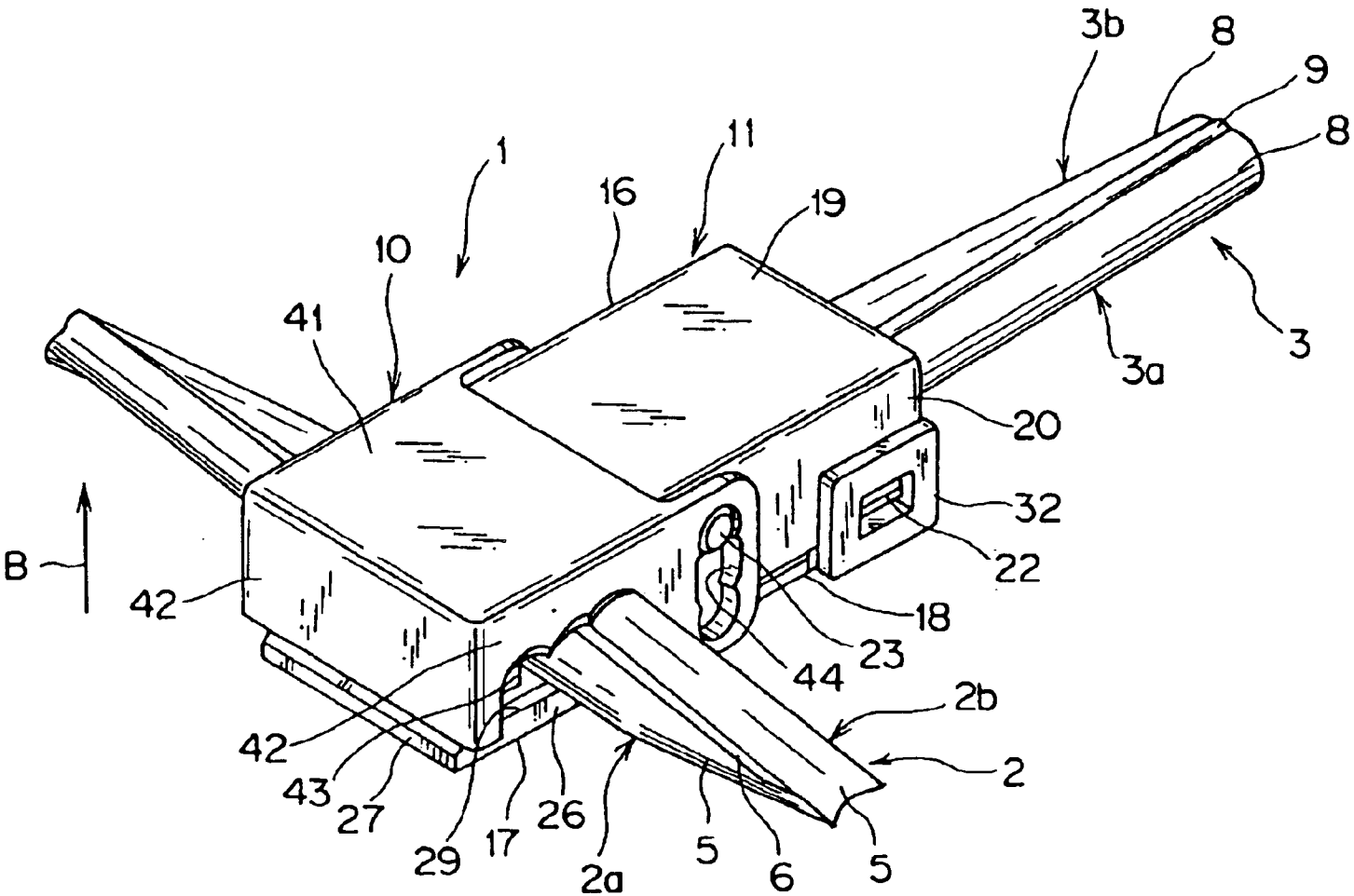
FIG. 20 is a perspective view showing an electrical connector according to a second embodiment of the invention.

Next, referring to FIGS. 20 and 21, an electrical connector of a second embodiment according to the present invention will be discussed. Components the same as those of the first embodiment have the same reference numerals, which will not be discussed again. An electrical connector 1 of the second embodiment does not have the lever 15 provided in the first embodiment. The other constitutions of the second embodiment are the same as the first embodiment.

Figure 21:
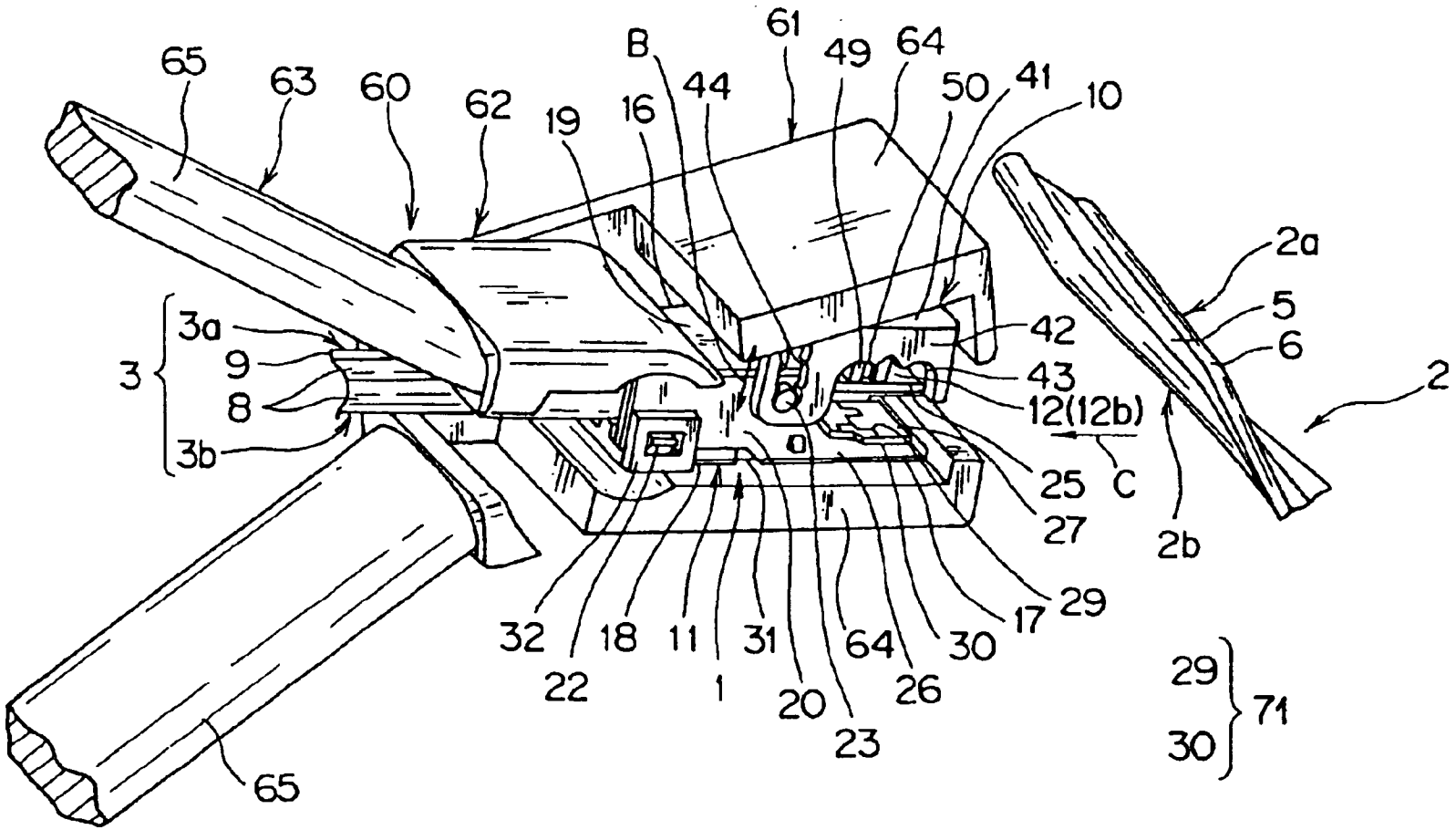
FIG. 21 is a perspective view showing a state in which the connector of FIG. 1 has not received electrical cables.

For fitting the press-fit terminals 12*a* and 12*b* of the electrical connector 1 of the second embodiment to the cables 2*a* and 2*b*, a tool 60 shown in FIG. 21 is prepared. The tool 60 is a pair of pincers having a pinching part 61, a fulcrum 62, and an actuating part 63. The pinching part 61 has a pair of pincers 64 coming close to and apart from each other to pinch the electrical connector 1 therebetween. The fulcrum 62 pivotably supports the pair of pincers 64 coming close to and apart from each other. A worker moves the pair of actuating levers 65 to come close to each other so that the pair of pincers 64 come close to each other.

The electrical connector 1 of the second embodiment is assembled in the same way as the first embodiment. First, between the vertical walls 20 of the second connector housing 11, the press-fit terminals 14*a* and 14*b* are received. Meanwhile, the press-fit terminals 12*a* and 12*b* are fitted to the wall 41 of the first connector housing 10. The elongated hole 44 of the first connector housing 10 receives the sliding protrusion 23 of the second connector housing 11 to couple the second connector housing 11 to the first connector housing 10.

By using the electrical connector 1 of the second embodiment, an additional electronic instrument can be connected to cables 2*a* and 2*b* which have been already arranged in a motor vehicle like the first embodiment. First, the cables 3*a* and 3*b* are fitted to the press-fit terminals 14*a* and 14*b*. Then, the lever 15 is pivoted around the hinges so that the locking arm 32 engages with the engagement protrusion 22.

As illustrated in FIG. 21, the tool 60 pinches the electrical connector 1, which has received the cables 3*a* and 3*b*, between the pair of pincers 64. The electrical connector 1 comes close to the cables 2*a* and 2*b* together with the tool 60 such that the cable holding portion 17 of the second connector housing 11 faces the cables 2*a* and 2*b*. The cables 2*a* and 2*b* advance into the cutout 29 of the cable holding portion 17, and the one cable 2*a* is positioned at a middle of the cutout 29. The other cable 2*b* may be inside or outside from the one cable 2*a* relative to the cable securing portion 16.

When the pair of actuating levers 65 come close to each other, the cable holding portion 17 of the first connector housing 10 slides toward the cable holding portion 17. Through the through hole 28 of the wall 25 of the cable holding portion 17, the press-fit blade 49 of the press-fit terminal 12*a* or 12*b* gradually advances into the cable holding portion 17, while the contact piece 40 of the press-fit terminal 14*a* or 14*b* gradually comes close to the contact piece 51 of the press-fit terminal 12*a* or 12*b*. The press-fit blades 49 of the press-fit terminals 12*a* and 12*b* fit to the cables 2*a* and 2*b* while the pieces 40 and 51 contact each other with a resilient force therebetween.

Thus, the one cable 3*a* electrically connects to the one cable 2*a* while the other cable 3*b* electrically connects to the other cable 2*b*, so that the additional electronic instrument can be electrically connected to the cables 2*a* and 2*b* which have been arranged in the vehicle.

The cable distinction devices 71 and 72 of the second embodiment function in the same way as the first embodiment. The shoulder 30 and the other projection 33*b* of the second embodiment function in the same way as the first embodiment. The pair of actuating levers 65 of the tool 60 are brought close to each other to surely slide the first connector housing 10 so that the press-fit terminals 12*a* and 12*b* are fitted to the cables 2*a* and 2*b*.

In the first and second embodiments, the one cable 2*a* has an outer diameter R the same as the other cable 2*b*, and the one cable 3*a* has an outer diameter Ra the same as the other cable 3*b*. However, the one cable 2*a* has the protrusion 6, and the one cable 3*a* has the protrusion 9. Thereby, the one cable 2*a* electrically connects correctly to the one cable 3*a* while the other cable 2*b* electrically connects correctly to the other cable 3*b*.

Figure 22:
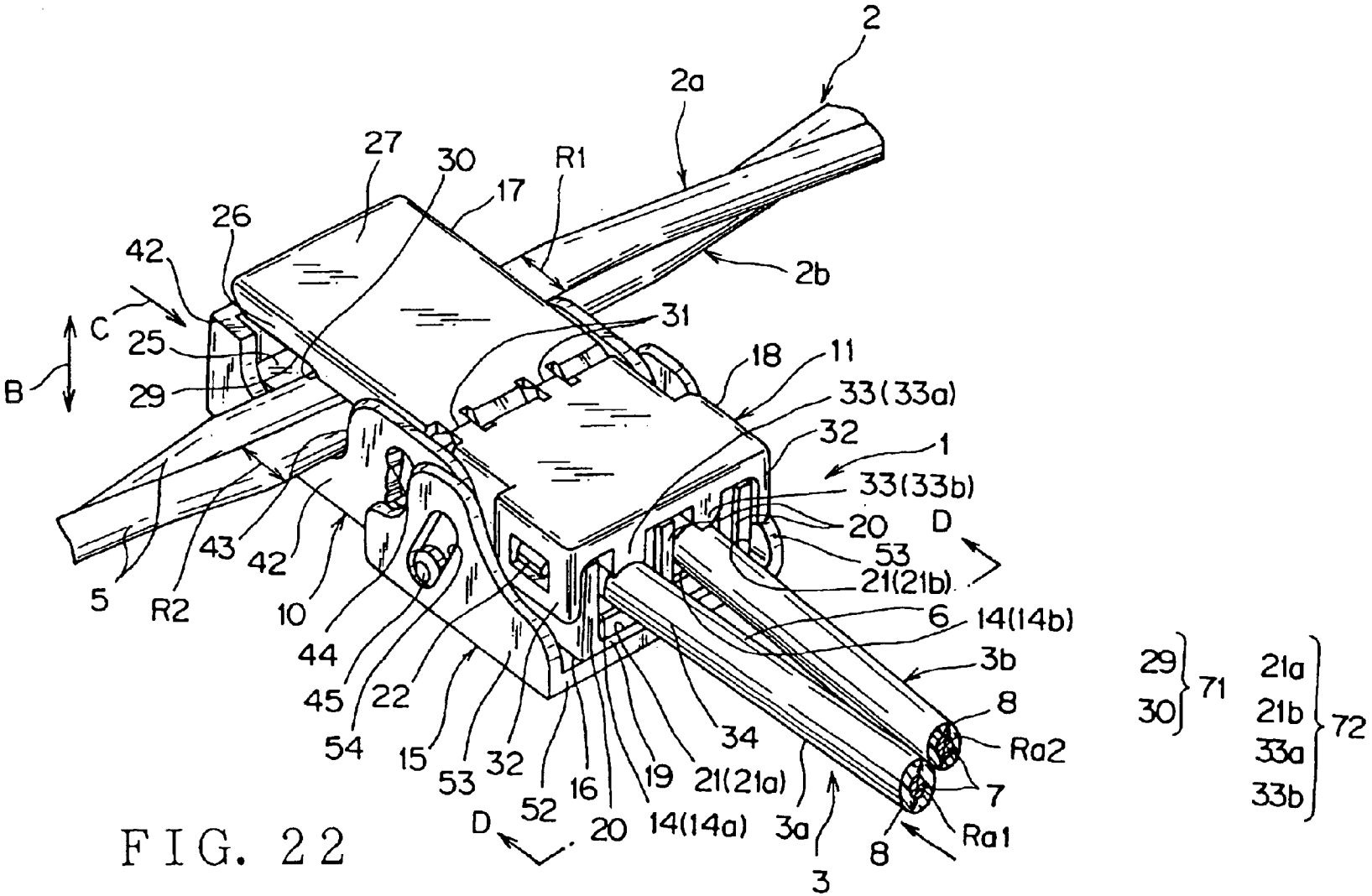
FIG. 22 is a perspective view showing an electrical connector according to a modified embodiment of the invention.
Figure 23:
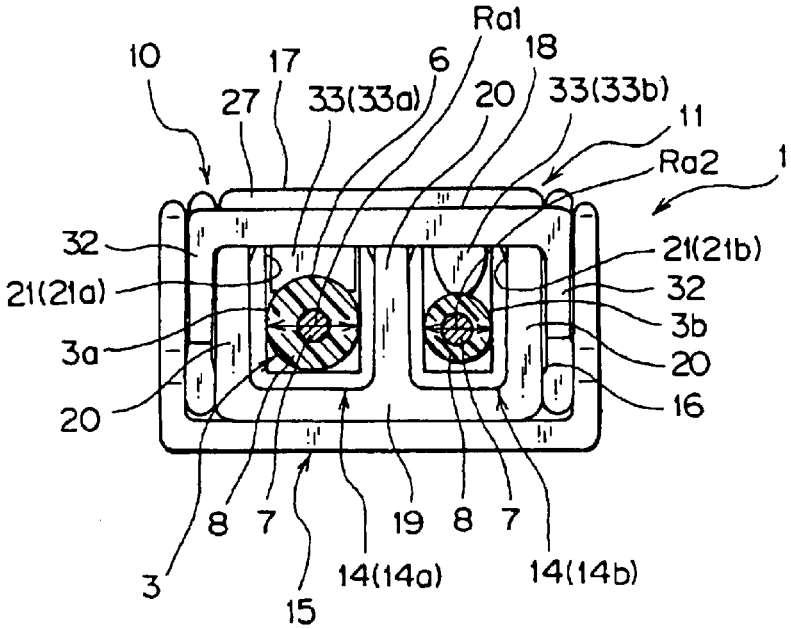
FIG. 23 is a sectional view taken along line XXIII—XXIII of FIG. 22.
Figure 24:
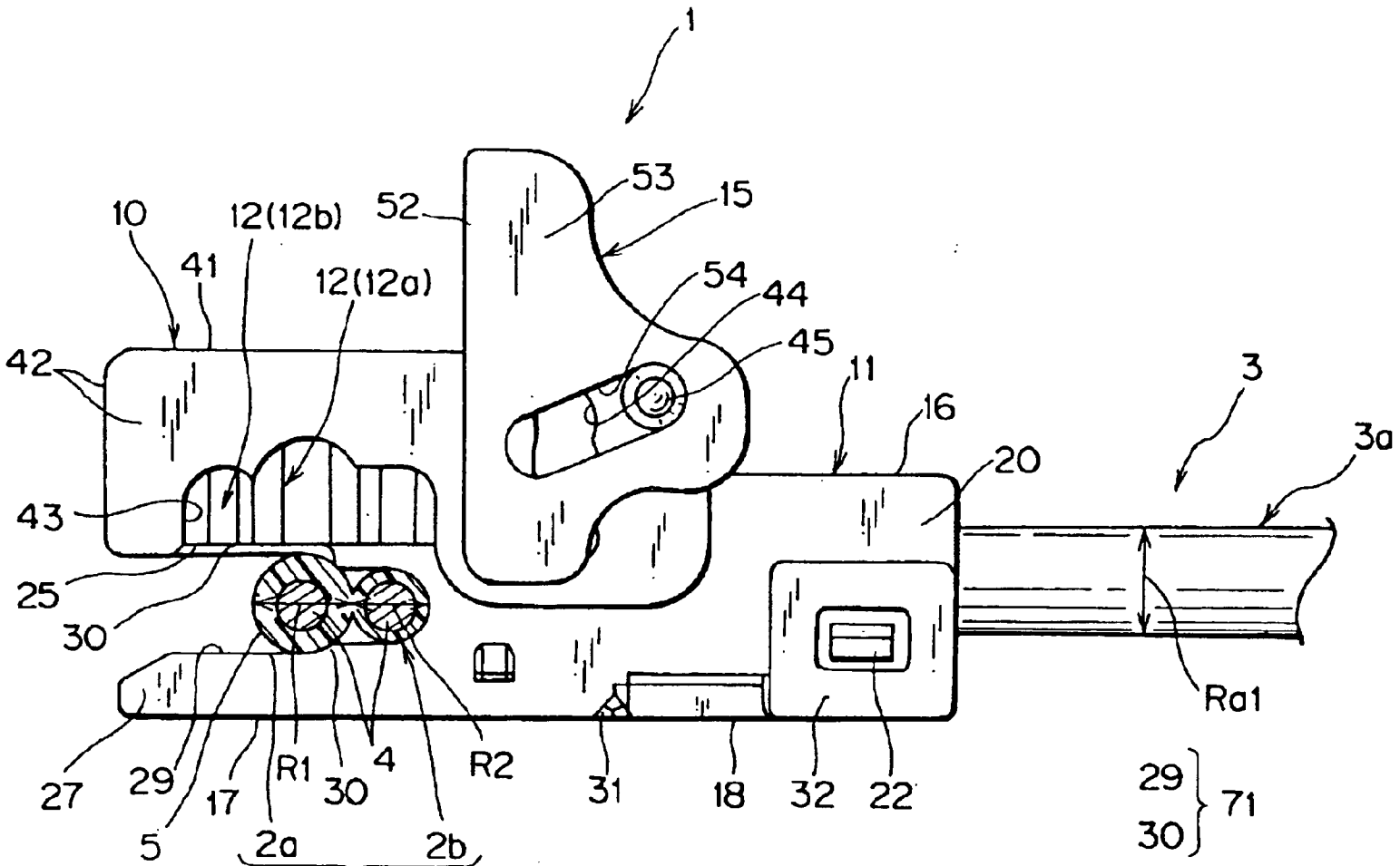
FIG. 24 is a side view showing a state in which the first pair electrical cable is moved into the cable receiving space of the connector from the state of FIG. 22.
Figure 25:
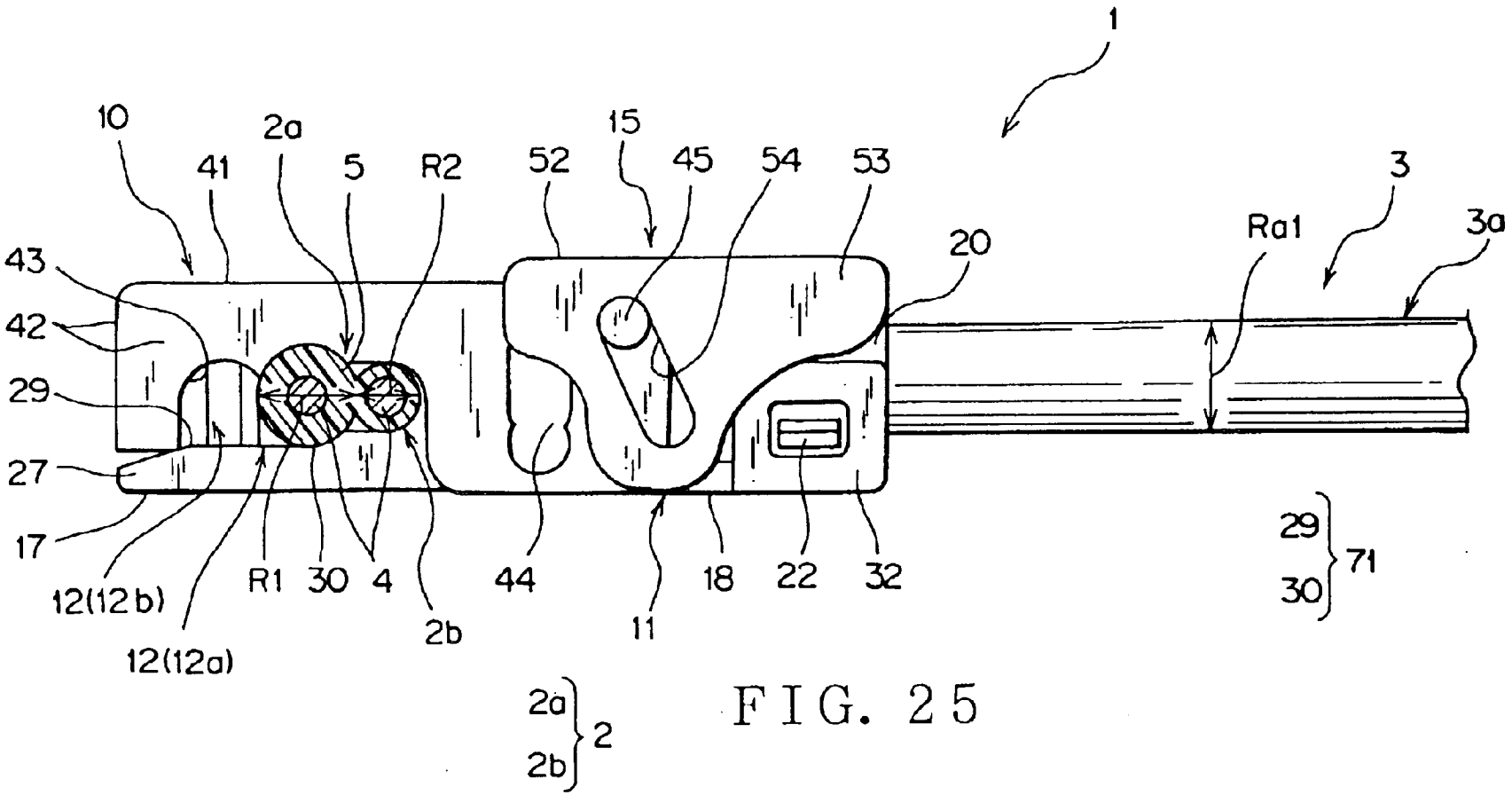
FIG. 25 is a side view showing a state in which the first connector housing is moved to the cable receiving space of the connector from the state of FIG. 24 by pivoting the cover.

Alternatively, according to the present invention, the one cable 2*a* may have an outer diameter R1 larger than an outer diameter R2 of the other cable 2*b* as shown in FIGS. 22, 24, and 25, while the one cable 3*a* may have an outer diameter Ra1 larger than an outer diameter Ra2 of the other cable 3*b* as shown in FIGS. 22 to 25. In FIGS. 22 to 25, components the same as those of the first embodiment have the same reference numerals, which will not be discussed again.

The one cable 2*a* having the larger diameter R1 interferes with the shoulder 30 not to reach an inner end of the cutout 29. Thereby, the one cable 2*a* is positioned at the middle of the cutout 29 in the arrow head C direction. Thus, the one cable 2*a* is distinguished from the other cable 2*b* in positioning thereof. The one cable 3*a* abuts against the other projection 33*b* to prevent the one cable 3*a* from being received in the other cable receiving chamber 21*b*. Meanwhile, the other cable 3*b* does not abut against the other projection 33*b* to be received in the other cable receiving chamber 21*b*. Thus, the one cable 3*a* is distinguished from the sliding protrusion 23 in positioning thereof.

Figure 26:
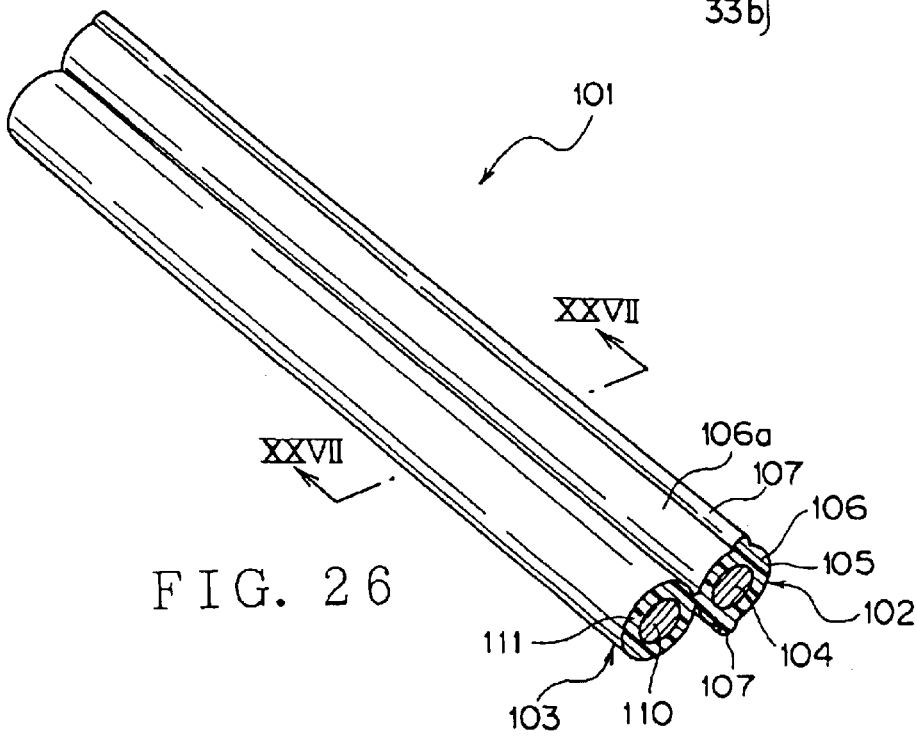
FIG. 26 is a perspective view showing a paired electrical cable of a first example according to the present invention.
Figure 27:
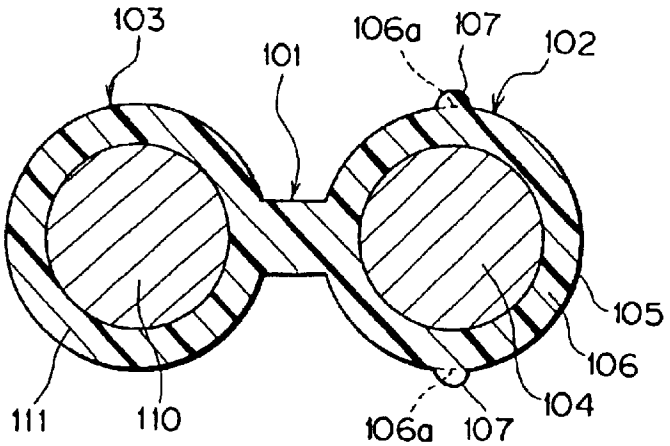
FIG. 27 is a sectional view taken along line XXVII—XXVII of FIG. 26.

Referring to FIGS. 26 and 27, a paired electrical cable related to the present invention will be discussed in detail. A paired electrical cable 1 consists of a pair of sheathed cables 102 and 103 disposed parallel to each other. The sheathed cable 102, which is positioned in a right side of the Figures, has an electrically conductive wire core 104 and an insulating sheath 105. The wire core 104 consists of a bundle of fine twisted conductors to have a round section. The conductors are made of an electrically conductive metal such as copper, a copper alloy, and an aluminum alloy. The wire core 104 may be constituted by a single conductor.

The sheath 105 is made of a synthetic resin material and covers the wire core 104. The sheath 105 has a main part 106 and a protrusion 107 unitarily formed on an outer surface 106*a* of the main part 106. The main part 106 has a round section perpendicular to a longitudinal direction of the sheathed cable 102. The main part 106 covers and protects the wire core 104. The protrusion 107 is extended over the whole length of the sheathed cable 102. A pair of the protrusions 107 are provided, which are symmetrically positioned in respect of a central axis of the sheath 105, i.e., of the sheathed cable 102.

The sheathed cable 103, which is positioned in a left side of the Figures, has an electrically conductive wire core 110 and an insulating sheath 111. The wire core 110 consists of a bundle of twisted fine conductors to have a round section. The conductors are made of an electrically conductive metal such as copper, a copper alloy, and an aluminum alloy. The wire core 110 may be constituted by a single conductor.

The sheath 111 is made of a synthetic resin material and covers the wire core 110. The sheath 111 has a round section perpendicular to a longitudinal direction of the sheathed cable 103.

The sheath 105 of the sheathed cable 102 is joined to the sheath 111 of the sheathed cable 103 over the whole longitudinal length thereof. The main part 106 of the sheath 105 of the sheathed cable 102 has a diameter equal to that of the sheath 111 of the sheathed cable 103.

The paired electrical cable 101 is used in a wiring harness arranged in a motor vehicle. Each of the sheathed cables 102 and 103 of the paired electrical cable 101 transmits a signal which is opposite in phase to a signal of the other, decreasing a noise generated by the sheathed cables 102 and 103.

In this example, the sheathed cable 102 has the protrusions 107 while the sheathed cable 103 has a round section for distinguishing the sheathed cables 102 and 103 from each other with ease.

Figure 28:
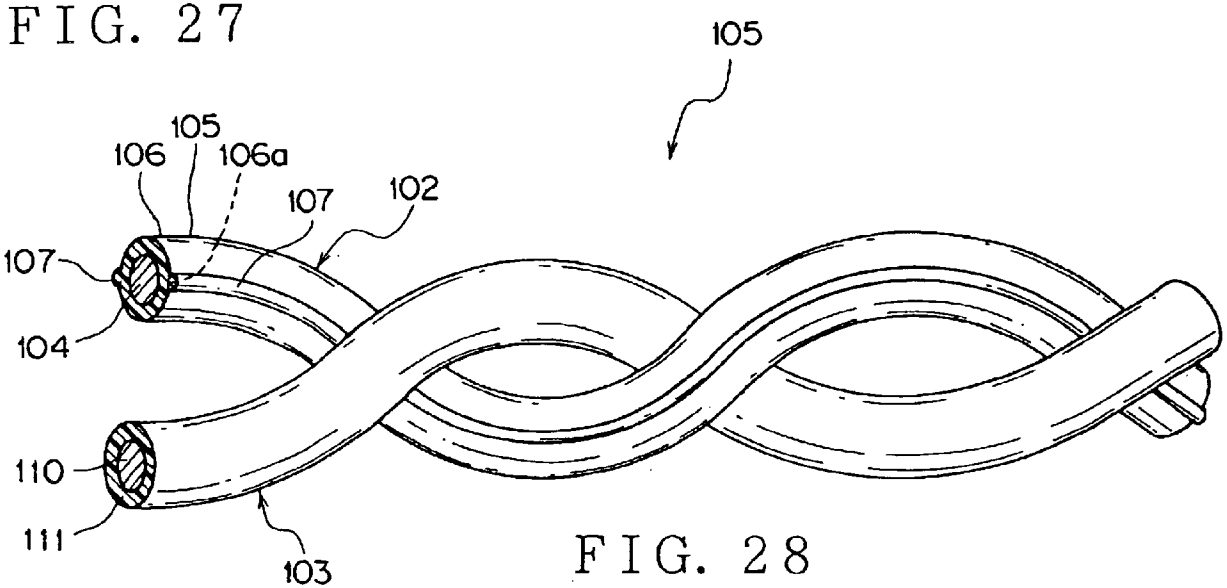
FIG. 28 is a perspective view showing a modified example of the paired electrical cable of FIG. 26.

In the example shown in FIGS. 26 and 27, the sheath 105 of the sheathed cable 102 is joined to the sheath 111 of the sheathed cable 103. However, as illustrated in FIG. 28, the sheath 105 of the sheathed cable 102 and the sheath 111 of the sheathed cable 103 may be formed in separate bodies. Such sheathed cables 102 and 103 may be preferably twisted together as illustrated in FIG. 28.

Figure 29:
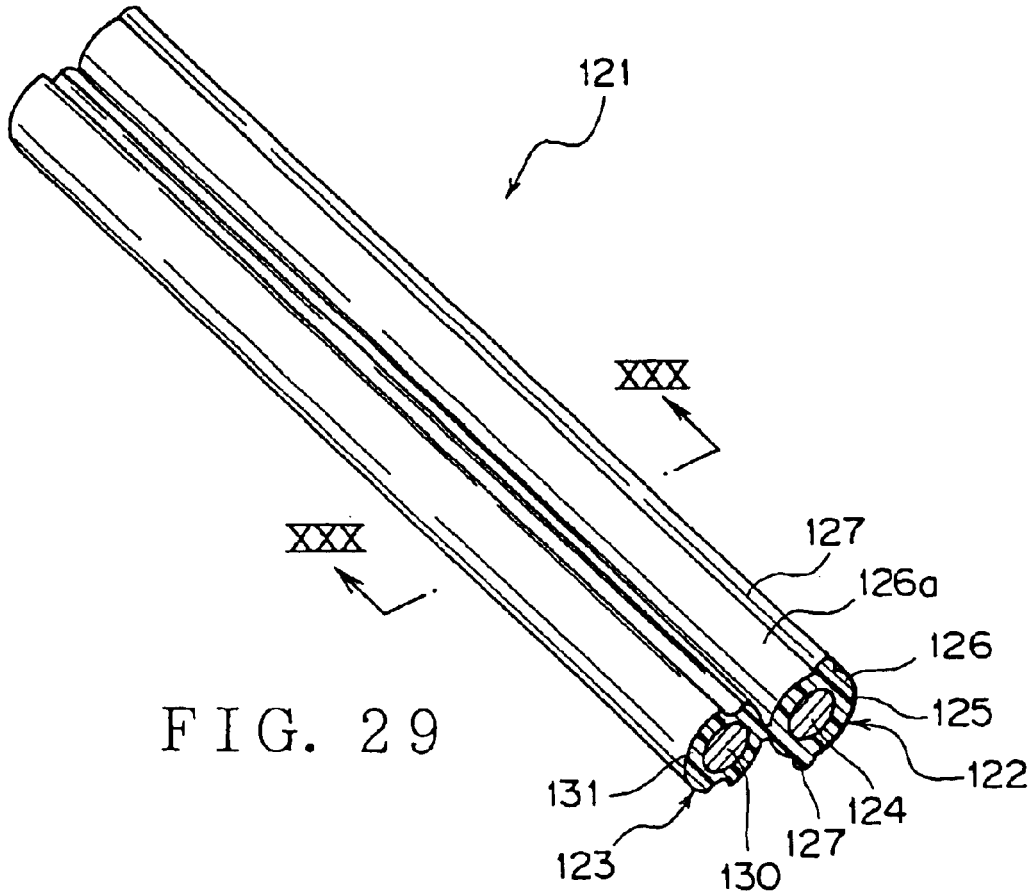
FIG. 29 is a perspective view showing a paired electrical cable of a second example according to the present invention.
Figure 30:
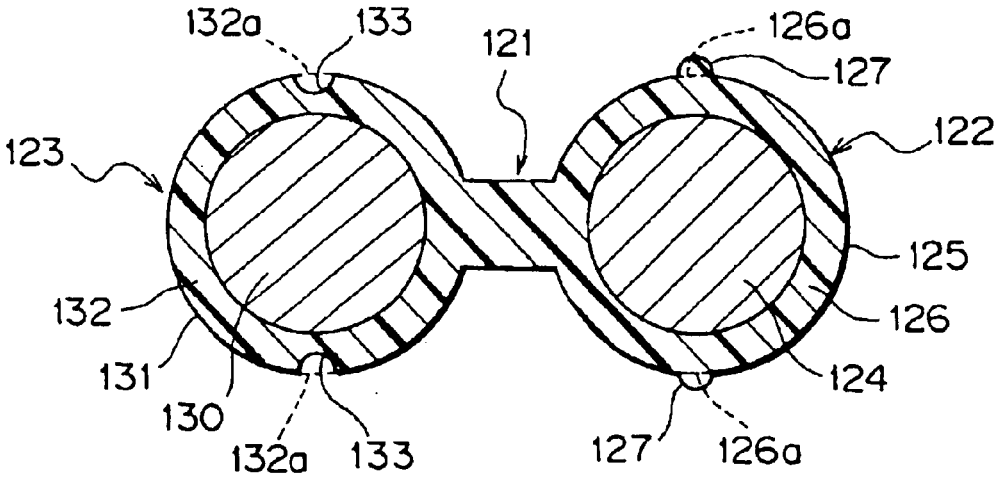
FIG. 30 is a sectional view taken along line XXX—XXX of FIG. 29.

Referring to FIGS. 29 and 30, a second example of a paired electrical cable related to the present invention will be discussed in detail. A paired electrical cable 121 consists of a pair of sheathed cables 122 and 123 disposed parallel to each other. The sheathed cable 122, which is positioned in a right side of the Figures, has an electrically conductive wire core 124 and an insulating sheath 125. The wire core 124 consists of a bundle of twisted fine conductors to have a round section. The conductors are made of an electrically conductive metal such as copper, a copper alloy, and an aluminum alloy. The wire core 124 may be constituted by a single conductor.

The sheath 125 is made of a synthetic resin material and covers the wire core 124. The sheath 105 has a main part 126 and a protrusion 127 unitarily formed on an outer surface 126*a* of the main part 126. The main part 126 has a round section perpendicular to a longitudinal direction of the sheathed cable 122. The main part 126 covers and protects the wire core 124. The protrusion 127 is extended over the whole length of the sheathed cable 102. A pair of the protrusions 127 are provided, which are symmetrically positioned in respect of a central axis of the sheath 125, i.e., of the sheathed cable 122.

The sheathed cable 123, which is positioned in a left side of the Figures, has an electrically conductive wire core 130 and an insulating sheath 131. The wire core 130 consists of a bundle of twisted fine conductors to have a round section. The conductors are made of an electrically conductive metal such as copper, a copper alloy, and an aluminum alloy. The wire core 130 may be constituted by a single conductor.

The sheath 131 is made of a synthetic resin material and covers the wire core 130. The sheath 131 has a main part 132 and a groove 133 unitarily formed on an outer surface 132*a* of the main part 132. The main part 132 has a round section perpendicular to a longitudinal direction of the main part 132. The main part 132 covers and protects the wire core 30. The groove 133 is extended over the whole length of the sheathed cable 123. A pair of the grooves 133 are provided, which are symmetrically positioned in respect of a central axis of the sheath 131, i.e., of the main part 132.

The sheath 125 of the sheathed cable 122 is joined to the sheath 131 of the sheathed cable 123 over the whole longitudinal length thereof. The main part 126 of the sheath 125 of the sheathed cable 122 has a diameter equal to that of the sheath 131 of the sheathed cable 123.

The paired electrical cable 121 is used in a wiring harness arranged in a motor vehicle. Each of the sheathed cables 122 and 123 of the paired electrical cable 121 transmits a signal which is opposite in phase to a signal of the other, decreasing a noise generated by the sheathed cables 122 and 123.

In this example, the sheathed cable 122 has the protrusions 127 while the sheathed cable 123 has the grooves 133 for distinguishing the sheathed cables 122 and 123 from each other with ease.

In the example shown in FIGS. 29 and 30, the sheath 125 of the sheathed cable 122 is joined to the sheath 131 of the sheathed cable 123. However, the sheath 125 of the sheathed cable 122 and the sheath 131 of the sheathed cable 123 may be formed in separate bodies. Such sheathed cables 122 and 123 may be preferably twisted together.

Figure 31:
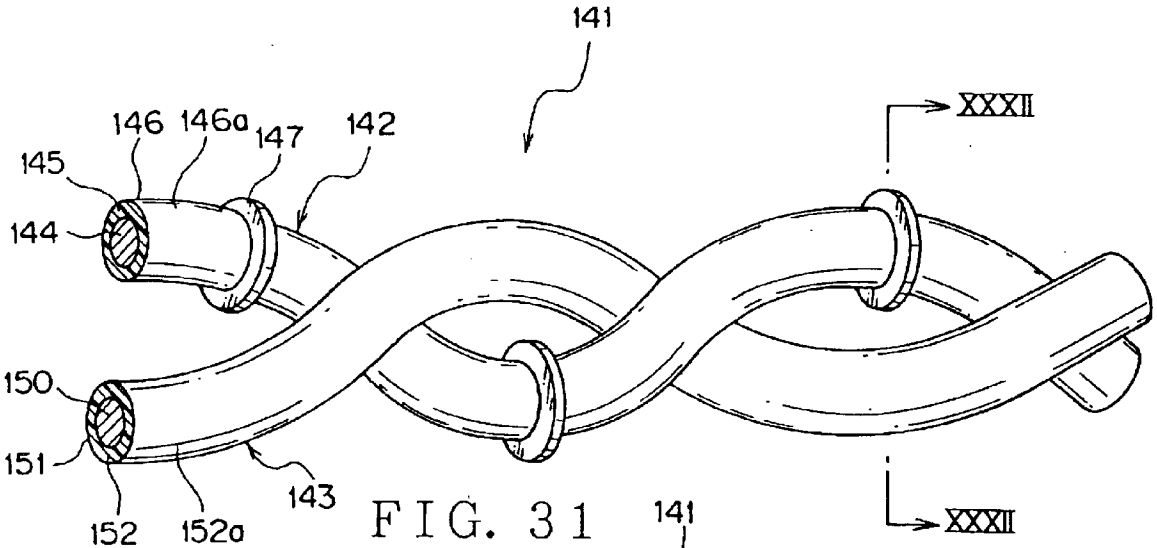
FIG. 31 is a perspective view showing a paired electrical cable of a third example according to the present invention.
Figure 32:
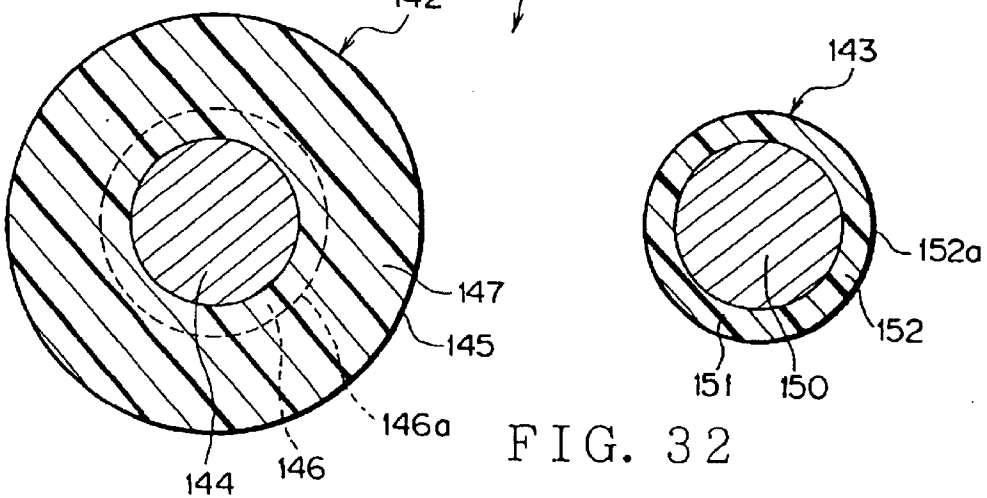
FIG. 32 is a sectional view taken along line XXXII—XXXII of FIG. 31.

Referring to FIGS. 31 and 32, a third example of a paired electrical cable related to the present invention will be discussed in detail. A paired electrical cable 141 consists of a pair of sheathed cables 142 and 143 disposed adjacent to each other. The sheathed cable 142 has an electrically conductive wire core 144 and an insulating sheath 145. The wire core 144 consists of a bundle of twisted fine conductors to have a round section. The conductors are made of an electrically conductive metal such as copper, a copper alloy, and an aluminum alloy. The wire core 144 may be constituted by a single conductor.

The sheath 145 is made of a synthetic resin material and covers the wire core 144. The sheath 145 has a main part 146 and a protrusion 147 unitarily formed on an outer surface 146*a* of the main part 146. The main part 146 has a round section perpendicular to a longitudinal direction of the sheathed cable 142. The main part 146 covers and protects the wire core 144. A plurality of the protrusions 147 are provided to be spaced from each other at uniform intervals in a longitudinal direction of the main part 146, i.e., of the sheathed cable 142.

The protrusion 147 is annularly formed on the outer surface 146*a* of the main part 146 to be coaxial with the main part 146.

The sheathed cable 143 has an electrically conductive wire core 150 and an insulating sheath 151. The wire core 150 consists of a bundle of twisted fine conductors to have a round section. The conductors are made of an electrically conductive metal such as copper, a copper alloy, and an aluminum alloy. The wire core 150 may be constituted by a single conductor.

The sheath 151 is made of a synthetic resin material and covers the wire core 150. The sheath 151 has a main part 152 with a round section perpendicular to a longitudinal direction of the main part 152.

The sheath 145 of the sheathed cable 142 is separated from the sheath 151 of the sheathed cable 143. The sheathed cables 142 and 143 are twisted with each other. The main part 146 of the sheath 145 of the sheathed cable 142 has a diameter equal to that of the sheath 151 of the sheathed cable 143.

The paired electrical cable 141 is used in a wiring harness arranged in a motor vehicle. Each of the sheathed cables 142 and 143 of the paired electrical cable 141 transmits a signal which is opposite in phase to a signal of the other, decreasing a noise generated by the sheathed cables 142 and 143.

In this example, the sheathed cable 142 has the protrusions 147 for distinguishing the sheathed cables 142 and 143 from each other with ease. The sheathed cable 143 may have a concave formed in the outer surface 152*a* of the main part 152 of the sheath 151.

Figure 33:
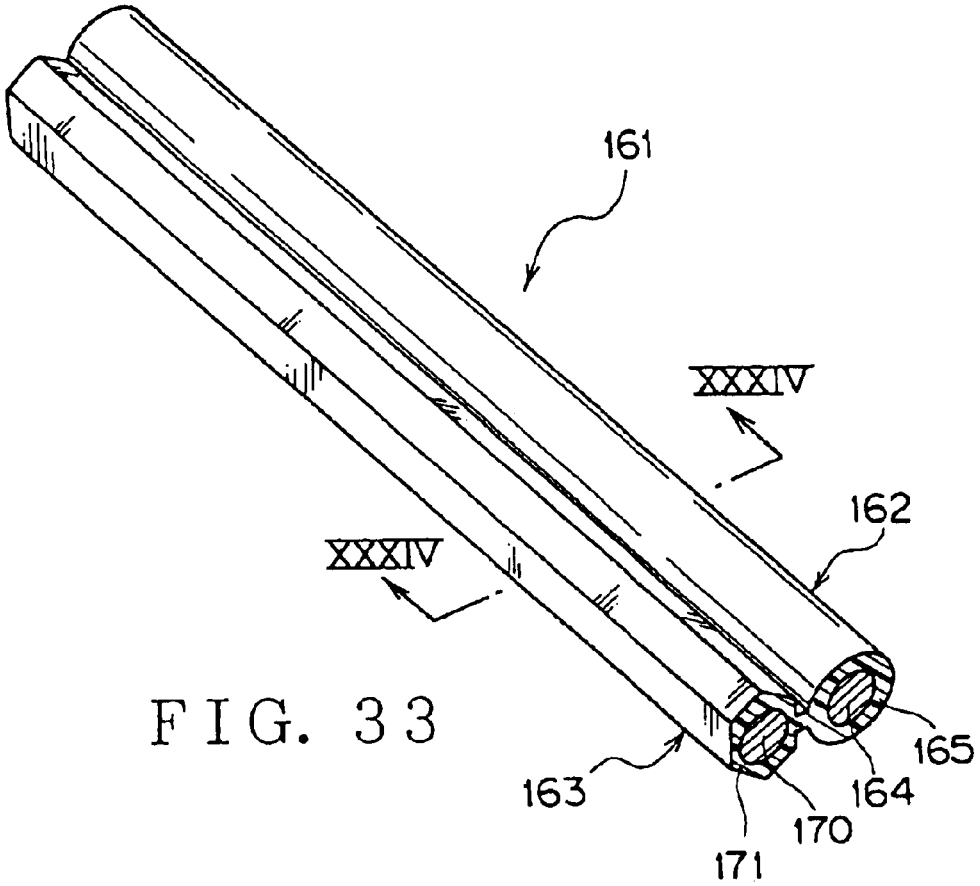
FIG. 33 is a perspective view showing a paired electrical cable of a fourth example according to the present invention.
Figure 34:
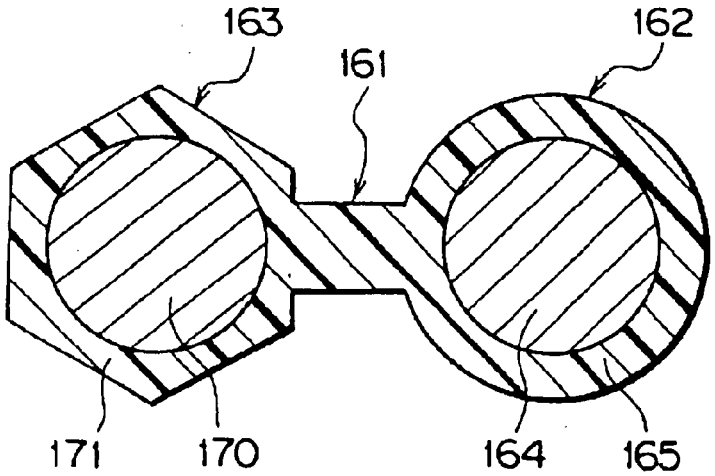
FIG. 34 is a sectional view taken along line XXXIV—XXXIV of FIG. 33.

Referring to FIGS. 33 and 34, a fourth example of a paired electrical cable related to the present invention will be discussed in detail. A paired electrical cable 61 consists of a pair of sheathed cables 162 and 163 disposed parallel to each other. The sheathed cable 162, which is positioned in a right side of the Figures, has an electrically conductive wire core 164 and an insulating sheath 165. The wire core 164 consists of a bundle of twisted fine conductors to have a round section. The conductors are made of an electrically conductive metal such as copper, a copper alloy, and an aluminum alloy. The wire core 164 may be constituted by a single conductor.

The sheath 165 is made of a synthetic resin material and covers the wire core 164. The sheath 165 has a round section perpendicular to a longitudinal direction of the sheathed cable 162. The sheath 165 covers and protects the wire core 164.

The sheathed cable 163, which is positioned in a left side of the Figures, has an electrically conductive wire core 170 and an insulating sheath 171. The wire core 170 consists of a bundle of twisted fine conductors to have a round section. The conductors are made of an electrically conductive metal such as copper, a copper alloy, and an aluminum alloy. The wire core 170 may be constituted by a single conductor.

The sheath 171 is made of a synthetic resin material and covers the wire core 170. The sheath 171 has a polygon section perpendicular to a longitudinal direction of the sheathed cable 163. In the example shown in FIGS. 33 and 34, the sheath 171 has a hexagon section. The sheath 171 covers and protects the wire core 170.

The sheath 165 of the sheathed cable 162 is joined to the sheath 171 of the sheathed cable 163 over the whole longitudinal length thereof. The wire core 64 of the sheathed cable 162 has a diameter equal to that of the wire core 170 of the sheathed cable 163.

The paired electrical cable 161 is used in a wiring harness arranged in a motor vehicle. Each of the sheathed cables 162 and 163 of the paired electrical cable 161 transmits a signal which is opposite in phase to a signal of the other, decreasing a noise generated by the sheathed cables 162 and 163.

In this example, the sheathed cable 162 has a round section while the sheathed cable 163 has a hexagon section for distinguishing the sheathed cables 162 and 163 from each other with ease.

The wire core 164 may have another polygon section such as an octagon.

In the example shown in FIGS. 33 and 34, the sheath 165 of the sheathed cable 162 is joined to the sheath 171 of the sheathed cable 163. However, the sheath 165 of the sheathed cable 162 and the sheath 171 of the sheathed cable 163 may be formed in separate bodies. Such sheathed cables 162 and 163 may be preferably twisted together.

Figure 35:
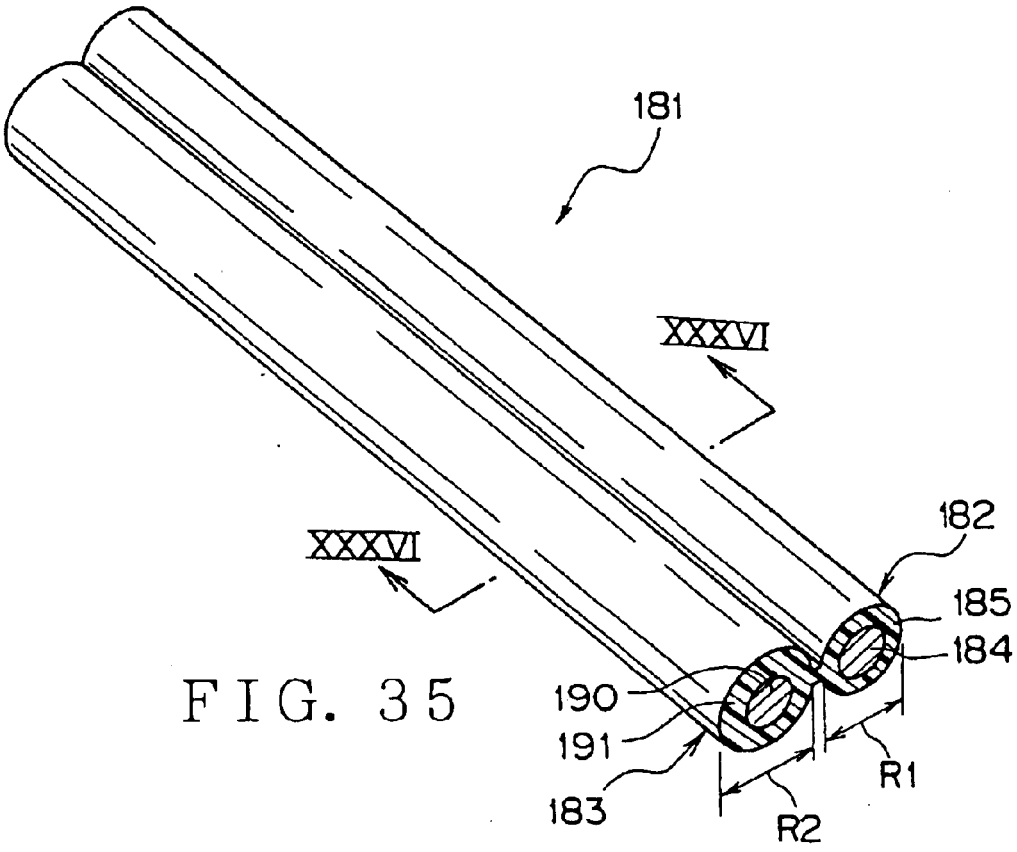
FIG. 35 is a perspective view showing a paired electrical cable of a fifth example according to the present invention.
Figure 36:
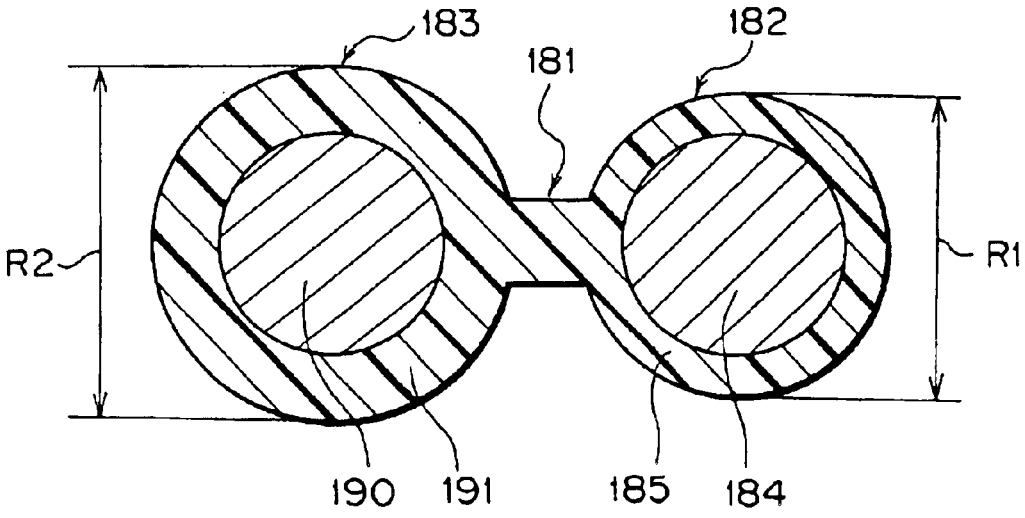
FIG. 36 is a sectional view taken along line XXXVI—XXXVI of FIG. 35.

Referring to FIGS. 35 and 36, a fifth example of a paired electrical cable related to the present invention will be discussed in detail. A paired electrical cable 181 consists of a pair of sheathed cables 182 and 183 disposed parallel to each other. The sheathed cable 182, which is positioned in a right side of the Figures, has an electrically conductive wire core 184 and an insulating sheath 185. The wire core 184 consists of a bundle of twisted fine conductors to have a round section. The conductors are made of an electrically conductive metal such as copper, a copper alloy, and an aluminum alloy. The wire core 184 may be constituted by a single conductor.

The sheath 185 is made of a synthetic resin material and covers the wire core 184. The sheath 185 has a round section perpendicular to a longitudinal direction of the sheathed cable 182. The sheath 185 covers and protects the wire core 184.

The sheathed cable 183, which is positioned in a left side of the Figures, has an electrically conductive wire core 190 and an insulating sheath 191. The wire core 190 consists of a bundle of twisted fine conductors to have a round section. The conductors are made of an electrically conductive metal such as copper, a copper alloy, and an aluminum alloy. The wire core 190 may be constituted by a single conductor.

The sheath 191 is made of a synthetic resin material and covers the wire core 190. The sheath 191 has a round section perpendicular to a longitudinal direction of the sheathed cable 183. The sheath 191 covers and protects the wire core 190.

The sheath 185 of the sheathed cable 182 is joined to the sheath 191 of the sheathed cable 83 over the whole longitudinal length thereof. The wire core 184 of the sheathed cable 182 has a diameter equal to that of the wire core 190 of the sheathed cable 183.

The sheath 185 of the sheathed cable 182 has an outer diameter R1, and the sheath 191 of the sheathed cable 183 has an outer diameter R2, R1 being different from R2.

The paired electrical cable 181 is used in a wiring harness arranged in a motor vehicle. Each of the sheathed cables 182 and 183 of the paired electrical cable 181 transmits a signal which is opposite in phase to a signal of the other, decreasing a noise generated by the sheathed cables 182 and 183.

In this example, the sheathed cable 182 has the diameter R1 different from the diameter R2 of the sheathed cable 183 for distinguishing the sheathed cables 182 and 183 from each other with ease.

In the example shown in FIGS. 35 and 36, the sheath 185 of the sheathed cable 182 is joined to the sheath 191 of the sheathed cable 183. However, the sheath 185 of the sheathed cable 182 and the sheath 191 of the sheathed cable 183 may be formed in separate bodies. Such sheathed cables 182 and 183 may be preferably twisted together.

What is claimed is:

1. An electrical connector having a pair of first and second terminal fittings each connected to each of a pair of first and second electrical cables and a connector housing holding the terminal fittings, wherein the electrical connector comprises a cable distinction device disposed in the connector housing to guide the first and second electrical cables for electrically connecting the first electrical cable exclusively to the first terminal fitting and the second electrical cable exclusively to the second terminal fitting, wherein the cable distinction device has a cutout with a shoulder, the cutout allowing insertion of the pair of electrical cables into the connector housing, the shoulder positioned at a middle of an inner length of the cutout, and the shoulder prevents the first electrical cable from advancing over the shoulder but allows the second electrical cable to advance over the shoulder, and wherein the first and second electrical cables have an outer diameter equal to each other, and the first electrical cable has a protrusion projecting from an outer surface of a sheath of the first electrical cable to abut against the shoulder of the cutout when inserted into the cutout.

* * * * *